US006618032B1

(12) United States Patent
Seino

(10) Patent No.: US 6,618,032 B1
(45) Date of Patent: Sep. 9, 2003

(54) DISPLAY APPARATUS HAVING FUNCTIONS OF DISPLAYING VIDEO SIGNALS AS ENLARGED/THINNED PICTURES

(75) Inventor: Kenichi Seino, Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 09/441,794

(22) Filed: Nov. 17, 1999

(30) Foreign Application Priority Data

Nov. 27, 1998 (JP) ..... 10-338257

(51) Int. Cl.[7] ..... G09G 3/36

(52) U.S. Cl. ..... 345/89; 345/98; 345/99; 345/100; 345/127; 345/456; 345/581; 348/580; 348/581; 348/582; 348/583

(58) Field of Search ..... 345/89, 98, 99, 345/100, 127; 348/456, 581, 582, 583, 580

(56) References Cited

U.S. PATENT DOCUMENTS

| | | | | | |
|---|---|---|---|---|---|
| 5,138,309 | A | * | 8/1992 | Gonzalez et al. | 340/783 |
| 5,267,296 | A | * | 11/1993 | Albert | 378/113 |
| 5,486,867 | A | * | 1/1996 | Hsu et al. | 348/516 |
| 5,801,672 | A | | 9/1998 | Masuda et al. | 345/98 |
| 5,864,347 | A | | 1/1999 | Inoue | 345/566 |
| 5,933,187 | A | * | 8/1999 | Hirasawa et al. | 348/240 |
| 6,064,444 | A | * | 5/2000 | Miyazaki et al. | 348/581 |
| 6,191,768 | B1 | * | 2/2001 | Imamura | 345/98 |
| 6,236,431 | B1 | * | 5/2001 | Hirasawa et al. | 348/240 |
| 6,281,869 | B1 | * | 8/2001 | Seino | 345/99 |

FOREIGN PATENT DOCUMENTS

| | | |
|---|---|---|
| DE | 195 40 146 A1 | 5/1996 |
| EP | 0725 379 A1 | 8/1996 |
| EP | 0730 258 A1 | 9/1996 |

* cited by examiner

*Primary Examiner*—Richard Hjerpe
*Assistant Examiner*—Abbas Abdulselam
(74) *Attorney, Agent, or Firm*—Brinks Hofer Gilson & Lione

(57) ABSTRACT

A display apparatus comprises driving a circuit having: a field discriminating circuit; a copy/thinning discriminating circuit; a pulse generating circuit for generating copy clock pulse signals in a horizontal period in addition to original clock pulse signals in an operation to display an enlarged picture; a gate-clock generating circuit for generating gate-clock signals obtained as a result of superposing all of the original clock pulse signals on some of the copy clock pulse signals the number of which is equal to a difference obtained as a result of subtraction of a vertical-pixel count of a video signal from a vertical-pixel count of a display unit; and a gate driver for generating a plurality of gate driving signals at a high level for pulses of the gate clock signals with timings different from each other.

23 Claims, 8 Drawing Sheets

DISPLAY APPARATUS HAVING FUNCTIONS OF DISPLAYING VIDEO SIGNALS AS ENLARGED/THINNED PICTURES

BACKGROUND OF THE INVENTION

1. Field of the Invention

The present invention relates to a display apparatus. More particularly, the present invention relates to a picture display apparatus which has the function of displaying a video signal with a number of vertical pixels different from the number of vertical pixels of a display unit of the picture display apparatus as an enlarged or thinned picture.

2. Description of the Related Art

Typically, in a picture display apparatus for a personal computer, the number of pixels on a display panel is prescribed by specifications such as VGA specifications, SVGA specifications, XGA specifications, SXGA specifications and UXGA specifications where VGA, SVGA, XGA, SXGA and UXGA are IBM's registered trademarks indicating commonly known representative specifications. In some cases, however, the number of pixels of a video signal supplied to a picture display apparatus may be different from the number of pixels on a display panel of the apparatus. For example, a picture conveyed by a VGA video signal is displayed on a display panel conforming to the XGA specifications. In such a case, it is necessary to display the video signal on the display panel as an enlarged or thinned picture.

When a video signal is displayed in the conventional system as a picture enlarged in the vertical direction, for example, data to be displayed on the area as an enlarged picture is stored in a memory and the data is then written onto a plurality of lines on the picture display apparatus. In this conventional system, however, peripheral components such as the memory and an A/D converter are required, making the picture display apparatus large in size and complicated. In order to solve this problem, there has been proposed the following method of displaying a video signal on a display panel as an enlarged picture without employing such peripheral components.

In a picture display apparatus having a function of displaying a video signal on a display panel thereof as an enlarged picture, a mode signal is set in a gate driver to indicate whether a video signal is to be displayed on the display panel normally or as an enlarged picture. During a horizontal period for outputting picture data of a line, driving of a gate line and driving of a plurality of gate lines are switched from one to another in dependence on the type of the mode signal. A gate line driven during a horizontal period will result in a normal display. On the other hand, a plurality of gate lines driven at the same time during a horizontal period will display picture data of a line on the same plurality of lines on the display screen, resulting in a display enlarged in the vertical direction. FIG. 8 is a timing diagram showing the operation of a gate driver employed in the picture display apparatus. FIG. 8A is a timing diagram for the normal mode while FIG. 8B is a timing diagram for an enlarge mode with a multiplication factor of two. As shown in FIG. 8B, gate output waveforms on two adjacent lines, namely X1 and X2 or X3 and X4, are generated at the same time.

In equipment such as a liquid-crystal display apparatus, there is generally adopted a technique whereby a supplementary capacitor is added to each pixel to hold electric charge during each scanning period. As a technique to lower the numerical aperture without using a capacitive electrode for forming a supplementary capacitor, a pixel electrode and a gate line are put in an overlapping layout to form a structure of a supplementary capacitor known as the so-called Cs on-gate structure. That is, the supplementary capacitor has a configuration comprising the pixel electrode and the gate line.

However, the enlarged-picture display technology can not be applied to a liquid-crystal display apparatus provided with supplementary capacitors each having the Cs on-gate structure. This is because, in the Cs on-gate structure, a gate line adjacent to a gate line driving a pixel serves as one of the electrodes of a supplementary capacitor of the pixel so that, when data is written into a pixel connected to one of the gate lines, that is, when the waveform output by the gate is set at a high level, the supplementary capacitor does not function unless the waveform output by a gate connected to the adjacent gate line is set at a low level. Since the technique to display an enlarged picture causes gates connected to two adjacent gate lines to output the same waveform, the supplementary capacitor does not function.

SUMMARY OF THE INVENTION

It is thus an object of the present invention addressing the problem to provide a display device which functions to display an enlarged picture and functions to display a shrunk (thinned) picture and is thus applicable to a picture display apparatus such as a liquid-crystal display apparatus provided with supplementary capacitors each having the Cs on-gate structure.

In order to achieve the object described above, the present invention provides a display apparatus that functions to display an enlarged picture. The display apparatus is characterized in that the apparatus is provided with a driving circuit having: a pulse generating means for generating second clock pulse signals to copy in a horizontal period in an operation to display a video signal having a vertical-pixel count smaller than a predetermined vertical-pixel count of a display unit as an enlarged picture on a screen of the display unit by using two kinds of fields in addition to as many original clock pulse signals as required in an operation to display a video signal having a vertical-pixel count equal to the predetermined vertical-pixel count of the display unit and for repeating generation of the original clock pulse signals and the second clock pulse signals for each horizontal period; a gate-clock generating means for receiving the original clock pulse signals and the second clock pulse signals from the pulse generating means and for generating gate-clock signals obtained as a result of superposing all of the original clock pulse signals on some of the second clock pulse signals wherein the number of the superposed second clock pulse signals is equal to a difference obtained as a result of subtraction of the vertical-pixel count of the video signal from the predetermined vertical-pixel count of the display unit and any adjacent two of the superposed second clock pulse signals pertain to the two kinds of fields separated from each other by at least two horizontal periods; and a gate driving means for receiving the gate clock signals from the gate-clock generating means and for generating gate driving signals used for driving as many gate lines as pulses of the gate clock signals for each horizontal period.

In a driving circuit employed in a display apparatus of the present invention having a function to display an enlarged picture, in the first place, a pulse generating means generates an original clock pulse signal and a second clock pulse signal for a copy purpose during a horizontal period. These clock pulse signals are generated repeatedly for each horizontal period. In order to generate gate clock signals having a number of pulses matching the vertical-pixel count of the display unit, the gate-clock generating means is used for generating gate-clock signals obtained as a result of superposing all of the original clock pulse signals on some of the second clock pulse signals wherein the number of the superposed second clock pulse signals is equal to a difference obtained as a result of subtraction of the vertical-pixel count of the video signal from a predetermined vertical-pixel count of the display unit. Then, the gate driving means receives the gate clock signals from the gate-clock generating means and generates a plurality of gate driving signals corresponding to pulses of the gate clock signals. The gate driving signals are generated with timings different from each other, being set at a high level for equal periods of time. It should be noted that a high-level period is a period between the rising edge of a pulse and the rising edge of the next pulse.

In such an operation, a plurality of gate lines are thus driven during a horizontal period. As a result, since the same video data of a line is displayed on a plurality of lines on the display unit, an enlarged picture matching the number of vertical pixels on the display unit is displayed thereon.

At that time, a plurality of gate driving signals driving the same plurality of gate lines are set at a high level with timing different from each other. Thus, unlike the conventional technique used to display an enlarged picture, two adjacent gate lines are never set at a high level at the same time. As a result, the technique provided by the present invention can be applied to a liquid-crystal display apparatus provided with supplementary capacitors each having a Cs on-gate structure without problems.

In addition, according to the present invention, in superposition of all of the original clock pulse signals on some of the second clock pulse signals, any adjacent two of the superposed second clock pulse signals pertain to the two kinds of fields separated from each other by at least two horizontal periods. The reason is described as follows. Assume that, unlike the configuration of the present invention, any adjacent two of the superposed second clock pulse signals pertain to the two kinds of fields not separated from each other by at least two horizontal periods in a display apparatus having a screen comprising the two kinds of fields, namely, odd and even fields. For example, two superposed second clock pulse signals are generated in adjacent horizontal periods along the time axis. In this case, a video signal of an odd field (or an even field) is copied into a specific gate line while a video signal of an even field (or an odd field) is copied into another gate line adjacent to the specific gate line.

Assume that the video signal in the state represents for example a slanting line to be displayed on the screen. In this case, a portion obtained as a result of the copy operation using the adjacent gate lines become striking in comparison with other portions. To the eyes of the user, the striking portion appears as a thick segment of the line or an unevenness. In the case of the present invention, on the other hand, any adjacent two of the superposed second clock pulse signals pertain to the two kinds of fields separated from each other by at least two horizontal periods. Thus, a video signal of an odd field (or an even field) is copied into a specific gate line while a video signal of an even field (or an odd field) is copied into another gate line separated away from the specific gate line. As a result, no striking portion appears as a thick segment of the line or an unevenness to the eyes of the user.

On the other hand, a display apparatus having a function to display a thinned picture is characterized in that the display apparatus is provided with a driving circuit having: a pulse generating means for displaying a screen on a display unit by using two kinds of fields by writing a video signal in a horizontal period into two adjacent gate lines of the display unit wherein, in an operation to display a video signal having a vertical-pixel count greater than a predetermined vertical-pixel count of the display unit, the video signal is thinned by generating a second clock pulse signal for a thinning purpose in a horizontal period in addition to two original clock pulse signals as required in an operation to display a video signal having a vertical-pixel count equal to the predetermined vertical-pixel count of the display unit and by repeating generation of the original clock pulse signals and the second clock pulse signals each having a pulse width equal to that of each of the original clock pulse signals for each horizontal period; a gate-clock generating means for receiving the original clock pulse signals and the second clock pulse signals from the pulse generating means and for generating gate-clock signals obtained as a result of superposing all of the original clock pulse signals on some of the second clock pulse signals wherein the number of the superposed second clock pulse signals is equal to a difference obtained as a result of subtraction of the vertical-pixel count of the display unit from the predetermined vertical-pixel count of the video signal and any adjacent two of the superposed second clock pulse signals pertain to the two kinds of fields separated from each other by at least two horizontal periods; and a gate driving means for receiving the gate clock signals from the gate-clock generating means and for generating gate driving signals used for driving as many gate lines as pulses of the gate clock signals for each horizontal period.

In the display apparatus that functions to display a thinned picture, first of all, a second clock pulse signal for a thinning purpose and original clock pulse signals are generated. The generation of the original clock pulse signals and the second clock pulse signals is repeated for each horizontal period. Then, in order to generate gate clock signals having a pulse count matching the number of vertical pixels of the display unit, the gate-clock generating means generates gate clock signals obtained as a result of superposition of all of the original clock pulse signals on some of the second clock pulse signals wherein the number of the superposed second clock pulse signals is equal to a difference obtained as a result of subtraction of the vertical-pixel count of the display unit from the predetermined vertical-pixel count of the video signal. In the superposition process, a second clock pulse signal is supplied to an inverter serving as a NOT gate. Then, the inverted second clock pulse signal and an original clock pulse signal are supplied to an AND gate to generate a gate clock signal. In this way, gate clock signals are obtained by eliminating as many pulses as inverted second clock pulse signals from original clock pulse signals. Finally, the gate driving means receives the gate clock signals from the gate-clock generating means, generating as many high-level gate driving signals as pulses of the gate clock signals with timings different from each other.

As a result of such operations, some of original clock pulse signals with a vertical-pixel count matching a predetermined horizontal-pixel count of the display unit are eliminated to result in a thinned (shrunk) display with a vertical-pixel count matching the predetermined horizontal-pixel count of the display unit.

In the operations, since a plurality of gate driving signals used for driving the same plurality of gate lines are raised to a high level with timings different from each other, the technique provided by the present invention can be applied to a liquid-crystal display apparatus provided with supplementary capacitors each having a Cs on-gate structure without problems as is the case with the effect exhibited by the function of displaying an enlarged picture.

It should be noted that, in the present invention, the function of displaying an enlarged picture and the function to display a thinned picture respectively enlarge and shrink a picture in the vertical direction and do not enlarge and shrink a display in the horizontal direction.

The display apparatus provided with a function of displaying a thinned picture also has a configuration wherein all of original clock pulse signals are superposed on some of second clock pulse signals with any adjacent two of the superposed second clock pulse signals pertaining to the two kinds of fields separated from each other by at least two horizontal periods for the same reason as the operation of displaying an enlarged picture. If any adjacent two of the superposed second clock pulse signals pertain to the two kinds of fields not separated from each other by at least two horizontal periods, for example, the two kinds of fields generated in two adjacent horizontal periods, video signals of an odd field and an even field appearing on adjacent gate lines will be thinned.

With video signals of for example a slanting line on adjacent gate lines thinned, the thin portions on the adjacent gate lines look striking, appearing as a broken line to the eyes of the user. In the case of the present invention, on the other hand, since any adjacent two of the superposed second clock pulse signals pertain to the two kinds of fields separated from each other by at least two horizontal periods, thinned portions of superposed second clock pulse signals pertaining to an odd field and an even field are distributed on gate lines separated from each other by at least two horizontal periods. As a result, broken portions of the slanting line are not seen by the user, making it possible to obtain a smooth picture.

In general, the driving technique adopted by the display apparatus is a line-sequential driving method which sequentially drives a plurality of gate lines from the top of the screen to the bottom one line after another. An alternative driving technique is an interlace driving method whereby a frame is divided into even and odd fields which are driven alternately by jumping from a gate line to another. The line-sequential driving method includes a technique whereby a frame is divided into even and odd fields and adjacent gate lines in a horizontal period are driven so as to drive all gate lines at a double speed. The present invention is specially suitable for a display apparatus adopting the double-speed line-sequential driving method.

According to the double-speed line-sequential driving method, since two gate lines are driven in a horizontal period, the original clock pulse signal provided by the present invention has a format comprising two pulses per horizontal period. Thus, particularly in the case of an operation to display a thinned picture, by merely eliminating one of the two pulses in appropriate horizontal periods, it is possible to easily generate a gate clock signal having pulses the number of which matches the number of horizontal pixels on the display unit. It is of course that the double-speed line-sequential driving method can also be applied to an operation to display an enlarged picture.

From this point of view, the double-speed line-sequential driving method can be applied to not only a TFT-type liquid-crystal display device but also liquid-crystal display devices of other systems. For example, the double-speed line-sequential driving method can be adapted to an STN-type liquid-crystal display device. Since the response speed of an STN-type liquid-crystal device is low in comparison with the frame frequency of the NTSC or PAL system, however, in the present state of the art, it is considered to be unsuitable for video displays of systems such as the NTSC and PAL systems. Nevertheless, applications to a ferroelectric liquid-crystal display (FLCD) and an antiferroelectric liquid-crystal display (AFLCD) each having a high response speed are possible.

In addition, in order to implement either the function of displaying an enlarged picture or the function of displaying a thinned picture, in a gate-clock generating means, it is desirable to allocate timings to superpose a second clock pulse signal on an original gate clock signal in a horizontal period uniformly to vertical pixels on the display unit.

By having such a configuration, it is possible to obtain a picture with a uniform quality across the entire screen of the display unit.

As described above, the display device provided by the present invention can be applied to a liquid-crystal display apparatus provided with supplementary capacitors each having a Cs on-gate structure without problems. Thus, with the display device of the present invention applied to a TFT-type liquid-crystal display apparatus, each pixel of the display unit employed in the TFT-type liquid-crystal display apparatus can be provided with an electric-charge accumulating capacitor comprising a gate line and a pixel electrode for the pixel.

BRIEF DESCRIPTION OF THE DRAWINGS

FIG. 8A shows timing charts of an ordinary mode; and FIG. 8B shows timing charts to display a picture with a double size in an enlarge mode.

DESCRIPTION OF THE PREFERRED EMBODIMENT

A preferred embodiment of the present invention is described by referring to FIGS. 1 to 7.

Figure 1:
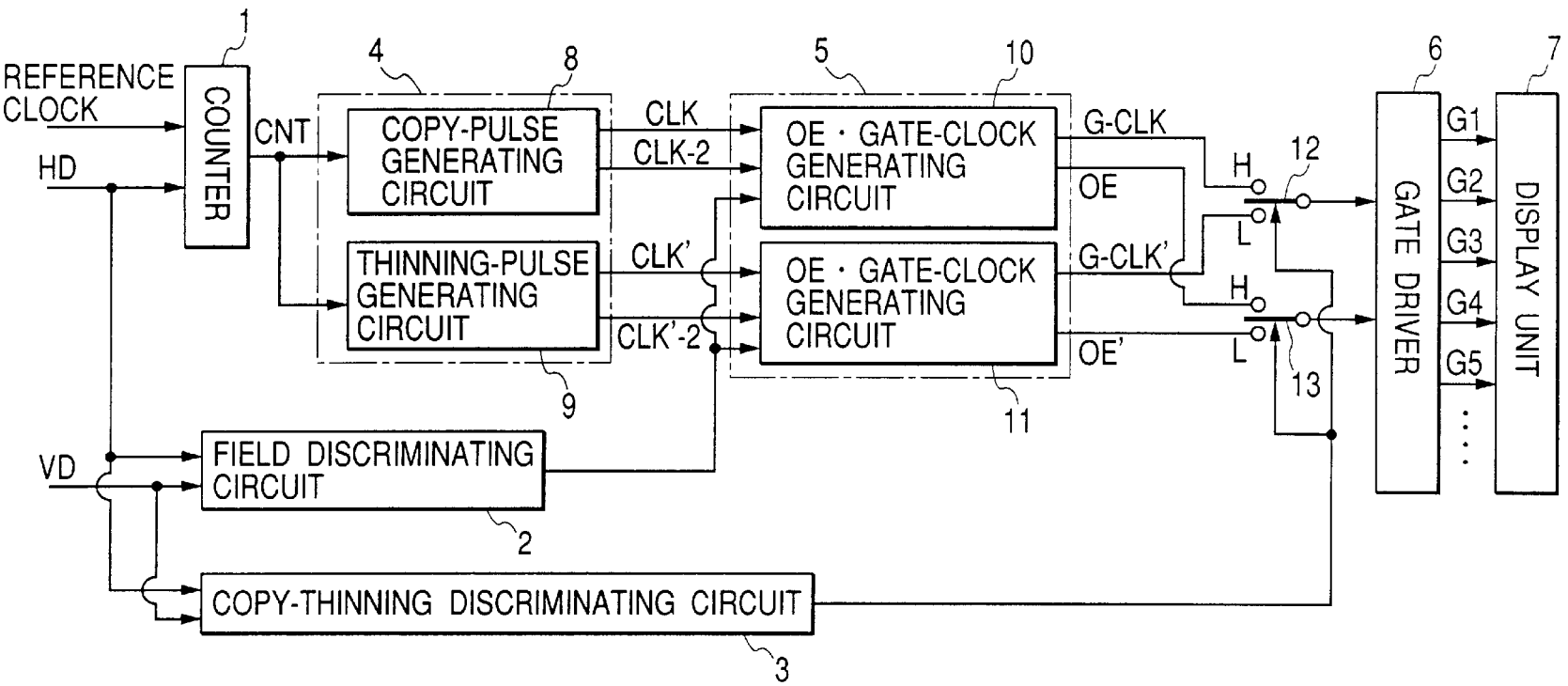
FIG. 1 is a block diagram showing the configuration of a liquid-crystal display apparatus implemented by an embodiment of the present invention.

FIG. 1 is a block diagram showing the configuration of a liquid-crystal display apparatus (a display apparatus) implemented by the embodiment. The liquid-crystal display apparatus implemented by the embodiment has both the function of displaying an enlarged picture for a video signal having a number of vertical pixels smaller than the number of vertical pixels on a display unit employed in the apparatus and the function of displaying a thinned picture for a video signal having a number of vertical pixels greater than the number of vertical pixels on a display unit employed in the apparatus.

As shown in FIG. 1, a driving circuit employed in the liquid-crystal display apparatus implemented by the embodiment comprises a counter 1, a field discriminating circuit 2 and a copy/thinning discriminating circuit 3. At stages subsequently following the counter 1, a pulse generating circuit 4 (a pulse generating means enclosed by a single-dotted line), a gate-clock generating circuit 5 (a gate-clock generating means enclosed by a single-dotted line) and a gate driver 6 (a gate driving means) are provided subsequently. In this configuration, signals output by the driving circuit, that is, gate driving signals G1, G2 and so on generated by the gate driver 6 are supplied to a display unit 7. The display unit 7 is implemented typically by a TFT-type LCD panel. Since the liquid-crystal display apparatus implemented by the embodiment has both the function to display an enlarged picture and the function to display a thinned picture, the pulse generating circuit 4 comprises a copy-pulse generating circuit 8 and a thinning-pulse generating circuit 9. By the same token, the gate-clock generating circuit 5 comprises OE (output enable) gate-clock generating circuits 10 and 11 associated with the copy-pulse generating circuit 8 and the thinning-pulse generating circuit 9 respectively.

The copy/thinning discriminating circuit 3 determines whether the number of vertical pixels of the video signal is smaller or greater than the number of vertical pixels on the display unit 7, outputting a signal fore closing either a switch 12 or 13 which are provided between the gate driver 6 and the two OE gate-clock generating circuits 10 and 11 respectively. By closing either the switch 12 or 13, a signal path is formed between the gate driver 6 and either the copy-pulse generating circuit 8 or the copy-pulse generating circuit 9 respectively.

It should be noted that, in this embodiment, the term 'copy' means an operation to display an enlarged picture and the term 'thinning' means an operation to display a shrunk picture.

Figure 2:
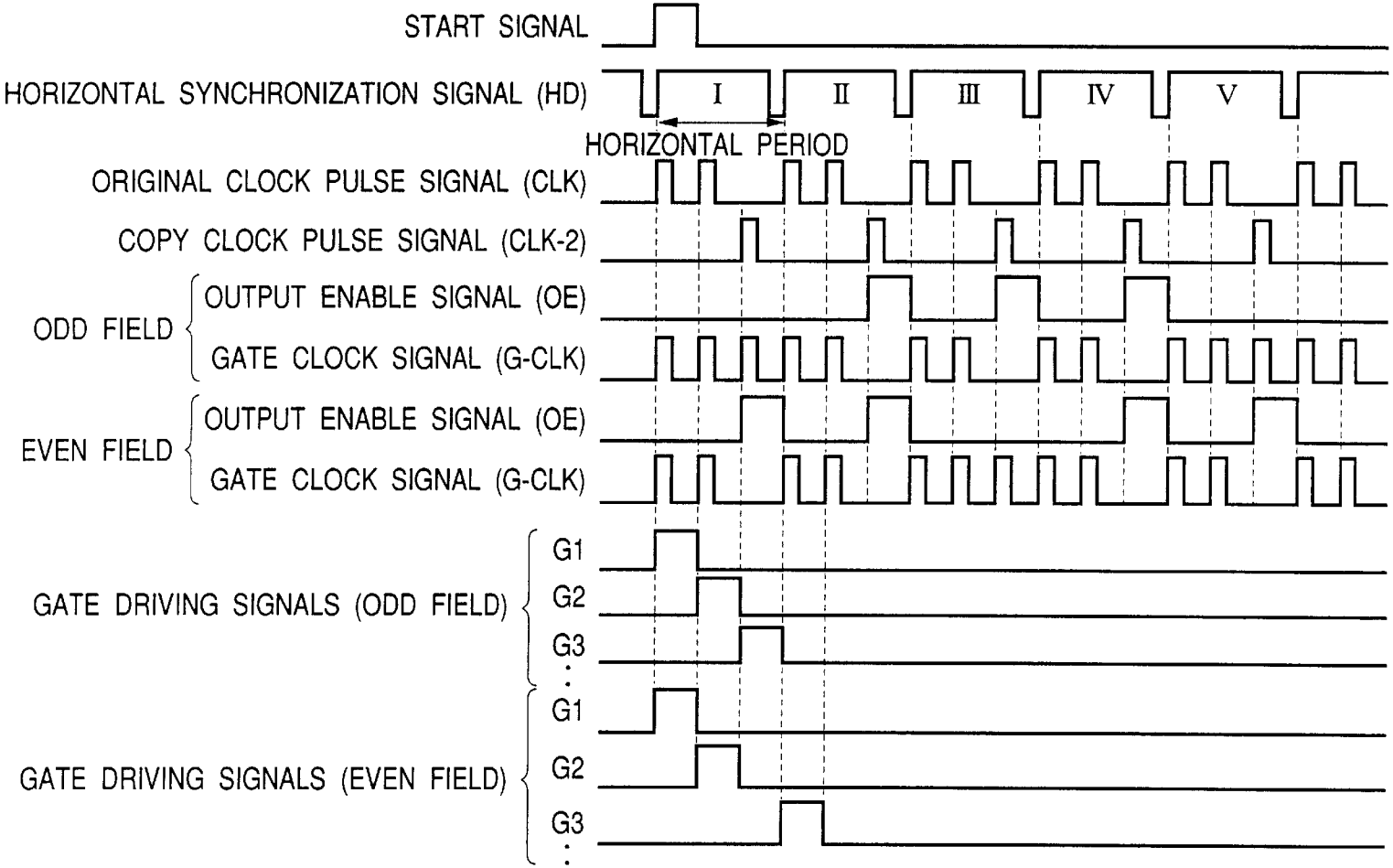
FIG. 2 shows timing charts of signals in an operation carried out by the liquid-crystal display apparatus to display a video signal as an enlarged picture.
Figure 3:
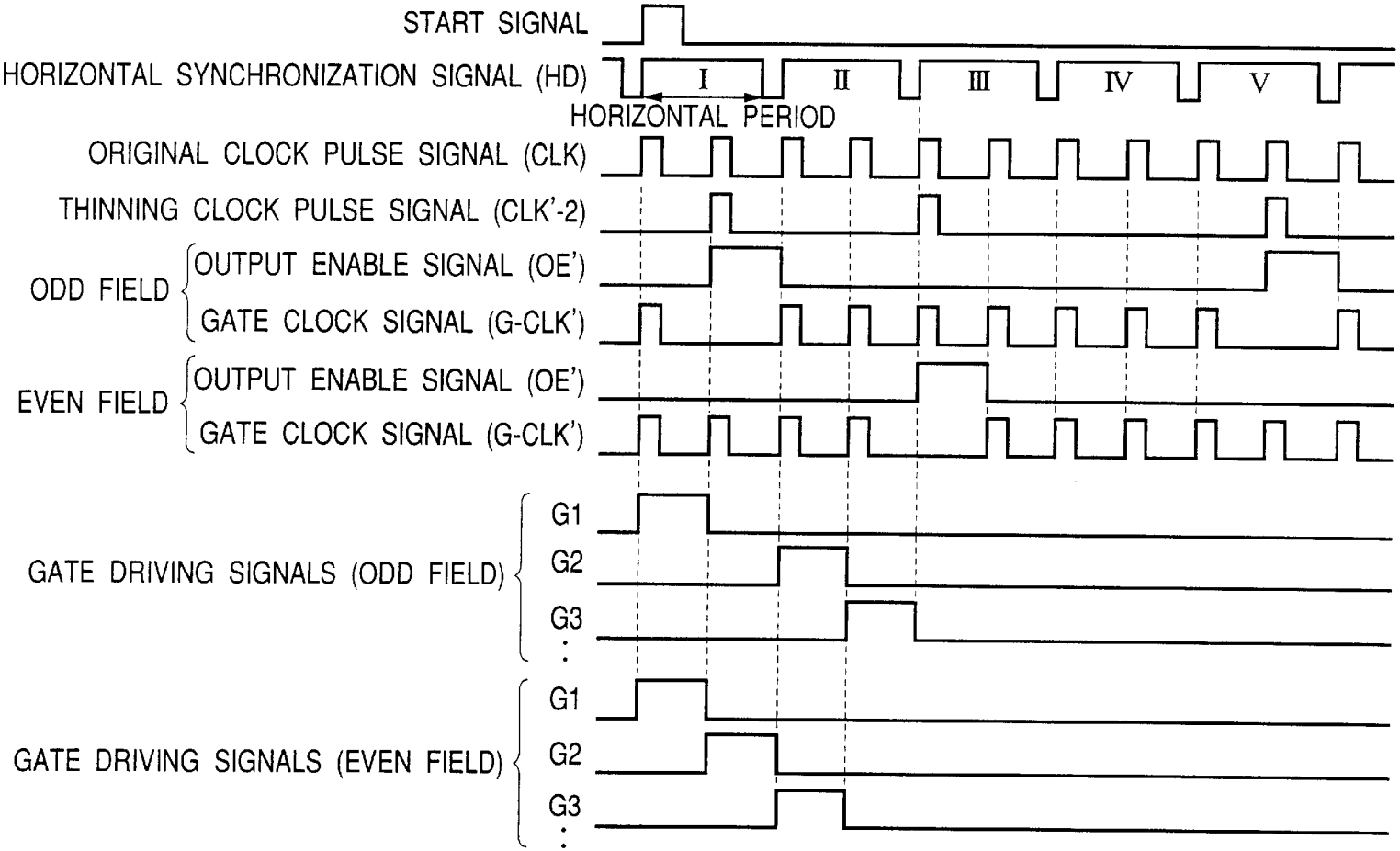
FIG. 3 shows timing charts of signals in an operation carried out by the liquid-crystal display apparatus to display a video signal as a thinned picture.

Next, the operation of the driving circuit of the liquid-crystal display apparatus having the configuration is explained by referring to FIGS. 1 to 3. The driving circuit carries out double-speed line-sequential driving.

As shown in FIG. 1, a horizontal-synchronization signal (HD) and a vertical-synchronization signal (VD) are supplied to the copy/thinning discriminating circuit 3 wherein the number of pulses in the horizontal-synchronization signal HD in a vertical period is counted to determine the type of the display system such as the, NTSC or the PAL. The copy/thinning discriminating circuit 3 then compares the number of vertical pixels of the video signal with the number of vertical pixels on the display unit 7 to select copy or thinning. A "High" or "Low" signal is output if copy or thinning is selected respectively. A "High" signal sets the switches 12 and 13 on the H pole side, while a "Low" signal sets the switches 12 and 13 on the L pole side.

The horizontal-synchronization signal (HD) and the vertical-synchronization signal (VD) are supplied to the field discriminating circuit 2 to determine whether the input signal is an odd-field signal or an even-field signal. A "High" or "Low" discrimination signal is output to the OE gate-clock generating circuits 10 and 11 to indicate that the input signal is an odd-field signal or an even-field signal respectively.

The following description begins with an example in which the number of vertical pixels of the video signal is smaller than the number of vertical pixels on the display unit 7 so that copy (an on operation to display a video signal as an enlarged picture) is selected. This example is explained by referring to FIG. 2.

First of all, a reference clock signal and a horizontal-synchronization signal are supplied to the counter 1. The counter 1 counts the number of reference clocks of the reference clock signal supplied thereto during a period of time between the horizontal-synchronization signal and a horizontal-synchronization signal received next. The number of clocks obtained as a result of the counting is then supplied to the copy-pulse generating circuit 8 from time to time. The number of clocks obtained as a result of the counting is denoted by notation CNT in the figure. The copy-pulse generating circuit 8 generates a pulse each time the clock count CNT becomes equal to a predetermined value. That is, pulses are generated at predetermined intervals. To be more specific, an original clock pulse signal CLK shown in FIG. 1 is generated on the rising edge of the horizontal-synchronization signal and another original clock pulse signal CLK is generated with a rising edge thereof coinciding with timing of a point at ⅓ of the horizontal period of time as shown in FIG. 2. In addition to these original clock pulse signals CLK, a second clock pulse signal for a copy purpose is generated with a rising edge thereof coinciding with timing of a point at ⅔ of the horizontal period of time. This second clock pulse signal is referred to hereafter simply as a copy clock pulse signal denoted by notation CLK-2 in FIG. 1.

Then, the OE gate-clock generating circuit 10 receives the original clock pulse signals CLK as well as the copy clock pulse signal CLK-2 from the copy-pulse generating circuit 8, and generates an OE signal. A function of the OE signal is to control and determine whether a copy clock pulse signal CLK-2 is to be superposed on an original clock pulse signal CLK during a horizontal period in generation of a gate clock signal described as follows. Denoted by notation G-CLK in FIG. 1, the gate clock signal has pulses obtained as a result of superposition of the copy clock pulse signal CLK-2 on the original clock pulse signal CLK wherein all pulses of the original clock pulse signal CLK are involved in the superposition. The number of superposed pulses in the copy clock pulse signal CLK-2 is equal to a difference obtained as a result of subtracting the number of vertical pixels of the video signal from the number of vertical pixels of the display unit 7. In order to include only some pulses of the copy clock pulse signal CLK-2 in the superposition, the OE signal is first inverted. Logical products of the inverted waveform of the OE signal and the copy clock pulse signal CLK-2 are then superposed on pulses of the original clock pulse signal CLK to produce a gate clock signal G-CLK including no pulses of the copy clock pulse signal CLK-2 at locations coinciding with the positions of pulses of the OE signal as shown in FIG. 2. Thus, only pulses of the copy clock pulse signal CLK-2 existing at locations other than the positions of pulses of the OE signal are involved in the superposition.

When a signal indicating an odd field is supplied by the field discriminating circuit 2 to the OE gate-clock generating circuit 10, the OE gate-clock generating circuit 10 generates high-level OE signals on the rising edges of pulses in the copy clock pulse signal CLK-2 during typically the horizontal periods II, III and IV so that, only during the remaining horizontal periods I and V of the horizontal periods I to V are pulses of the copy clock pulse signal CLK-2 involved in the superposition of the copy clock pulse signal CLK-2 on the original clock pulse signal CLK as shown in FIG. 2. When a signal indicating an even field is supplied by the field discriminating circuit 2 to the OE gate-clock generating circuit 10, on the other hand, the OE gate-clock generating circuit 10 generates high-level OE signals on the rising edges of pulses in the copy clock pulse signal CLK-2 during the horizontal periods I, II, IV and V so that, only during the remaining horizontal period III is a pulse of the copy clock pulse signal CLK-2 involved in the superposition of the copy clock pulse signal CLK-2 on the original clock pulse signal CLK as shown in FIG. 2.

Thus, pulses of the copy clock pulse signal CLK-2 involved in the superposition of the copy clock pulse signal CLK-2 on the original clock pulse signal CLK during the horizontal periods I and V for odd fields are separated from a pulse of the copy clock pulse signal CLK-2 involved in the superposition during the horizontal period III for an even field by two horizontal periods. A pulse of the copy clock pulse signal CLK-2 involved in the superposition of the copy clock pulse signal CLK-2 on the original clock pulse signal CLK for an odd field is separated from a pulse of the copy clock pulse signal CLK-2 involved in the superposition for an even field by two horizontal periods by waveforms of OE signals generated by a latch circuit employed in the OE gate-clock generating circuit 10 which also includes a counter for measuring the number of horizontal periods.

Then, the gate clock signal G-CLK and the OE signal generated by the OE gate-clock generating circuit 10 are supplied to the gate driver 6 by way of the switch 12. The gate driver 6 then outputs a plurality of gate driving signals denoted by notations G1, G2, G3 and so on in FIG. 1 for the odd and even fields to the display unit 7. Basically, each of the gate driving signals rises to a high level on the rising edge of a pulse of the gate-clock signal G-CLK and falls back to a low level on the rising edge of the next pulse of the gate-clock signal G-CLK. Another function of the OE signal is to bring back a gate driving signal from the high level to the low level. For example, the gate driving signal G2 for the even field shown in FIG. 2 rises to the high level on the rising edge of a second pulse of the gate clock signal G-CLK and falls back to the low level on the rising edge of the OE signal.

Then, a plurality of gate lines in the display unit 7 are driven by the same plurality of gate driving signals G1, G2, G3 and so on. At that time, a Start signal rises to a high level and an operation to output the gate driving signal G1 is started on the rising edge of the first pulse of the gate clock signal G-CLK. That is, the Start signal is a signal for determining timing to output the first line, that is, the uppermost horizontal line on the TFT-type-LCD display unit 6.

The following description explains a case, in which the number of vertical pixels in the video signal is greater than the number of vertical pixels on the display unit 7 so that an operation to display a thinned picture (a shrunk picture) needs to be carried out. This case is described by referring to FIG. 3.

The operation of the counter 1 is the same as the copy case. To put it in detail, the counter 1 counts the number of reference clocks of the reference clock signal supplied thereto during a period of time between the horizontal-synchronization signal and a horizontal-synchronization signal received next. The number of clocks CNT obtained as a result of the counting is then supplied to the thinning-pulse generating circuit 9 from time to time. The thinning-pulse generating circuit 9 generates a pulse each time the clock count CNT becomes equal to a predetermined value. To be more specific, an original clock pulse signal CLK' shown in FIG. 1 is generated on the rising edge of the horizontal-synchronization signal and another original clock pulse signal CLK' is generated with a rising edge thereof coinciding with timing of a point at ½ of the horizontal period of time as shown in FIG. 3. The original clock pulse signal CLK' is the native clock pulse signal of a double-speed line-sequential driving method. In addition to these original clock pulse signals CLK', a second clock pulse signal for a thinning purpose is generated. This signal is referred to hereafter simply as a thinning clock pulse signal denoted by notation CLK'-2 in FIG. 1. The thinning clock pulse signal CLK'-2 has a pulse for determining timing to carry out thinning on pulses of the original clock pulse signal CLK'.

Then, the OE gate-clock generating circuit 11 receives the original clock pulse signals CLK' as well as the thinning clock pulse signal CLK'-2 from the thinning-pulse generating circuit 9, and generates an OE signal synchronized with timing of the rising edge of a pulse of the thinning clock pulse signal CLK'-2. The OE signal is a signal OE' shown in FIG. 1. Denoted by notation G-CLK' in FIG. 1, a gate clock signal is generated to comprise pulses obtained as a result of superposition of the thinning clock pulse signal CLK'-2 on the original clock pulse signal CLK' wherein all pulses of the original clock pulse signal CLK' are involved in the superposition. In the process of superposition, the OE signal is inverted by a NOT gate to produce an inverted waveform of the OE signal. Logical products of the inverted waveform of the OE signal and the original clock pulse signal CLK' generated by an AND gate form a gate clock signal G-CLK'.

Thus, the gate clock signal G-CLK' is held at a low level during a high-level period of the OE signal which starts on the rising edge of a pulse of the thinning clock pulse signal CLK'-2. As a result, at the locations of pulses of the original clock pulse signal CLK'-2, pulses of the original clock pulse signal CLK' are eliminated. At the locations where no pulses of the original clock pulse signal CLK'-2 exist, on the other hand, pulses of the original clock pulse signal CLK' remain in the signal G-CLK' as they are.

When a signal indicating an odd field is supplied by the field discriminating circuit 2 to the OE gate-clock generating circuit 11, the OE gate-clock generating circuit 11 generates high-level OE signals on the rising edges of pulses in the thinning clock pulse signal CLK'-2 during typically the horizontal periods I and V so that, only during the horizontal periods I and V of the horizontal periods I to V are pulses of the original clock pulse signal CLK' eliminated as shown in FIG. 3. When a signal indicating an even field is supplied by the field discriminating circuit 2 to the OE gate-clock generating circuit 11, on the other hand, the OE gate-clock generating circuit 11 generates a high-level OE signal on the rising edge of a pulse in the thinning clock pulse signal CLK'-2 during the horizontal period III so that, only during the horizontal period III is a pulse of the original clock pulse signal CLK' eliminated as shown in FIG. 3.

Thus, pulses of the thinning clock pulse signal CLK'-2 involved in the elimination of pulses from the original clock pulse signal CLK' during the horizontal periods I and V for odd fields are separated from a pulse of the thinning clock pulse signal CLK'-2 involved in the elimination of pulses from the original clock pulse signal CLK' during the horizontal period III for an even field by horizontal periods. Much like the operation to display an enlarged picture, a pulse of the thinning clock pulse signal CLK'-2 involved in the elimination of pulses from the original clock pulse signal CLK' for an odd field is separated from a pulse of the thinning clock pulse signal CLK'-2 involved in the elimination of pulses from the original clock pulse signal CLK' for an even field by horizontal periods by waveforms of OE signals generated by a latch circuit employed in the OE gate-clock generating circuit 11 which also includes a counter for measuring the number of horizontal periods.

Then, much like the copy display operations, the gate clock signal G-CLK' for odd and even fields and the OE signal generated by the OE gate-clock generating circuit 11 are supplied to the gate driver 6. The gate driver 6 then outputs a plurality of gate driving signals denoted by notations G1, G2, G3 and so on in FIG. 1 for the odd and even fields to the display unit 7. Basically, each of the gate driving signals rises to a high level on the rising edge of a pulse of the gate-clock signal G-CLK' and falls back to a low level on the rising edge of the next pulse of the gate-clock signal G-CLK'. It should be noted, however, that the gate driving signal G1 for the odd field shown in FIG. 3 rises to the high level on the rising edge of a first pulse of the gate clock signal G-CLK' and falls back to the low level on the rising edge of the OE signal. Then, a plurality of gate lines in the display unit 7 are driven by the same plurality of gate driving signals G1, G2, G3 and so on.

As described above, in the liquid-crystal display apparatus provided by the embodiment, the driving circuit is capable of carrying out both operations to display an enlarged picture and a thinned picture. In the case of an operation to display an enlarged picture, during a horizontal period, two or three gate lines are driven as shown in FIG. 2 so that video data of the same line is displayed on a plurality of lines on the display unit 7. As a result, an enlarged picture matching the number of vertical pixels on the display screen is displayed on the display unit 7. In the case of an operation to display a thinned picture, on the other hand, two pulses are eliminated from the original clock pulse signal CLK' in each horizontal period as is the case with a conventional technique adopted in the double-speed line-sequential system to display a thinned picture matching the number of vertical pixels on the display unit 7.

As described above, in the case of the embodiment, in an operation to display a enlarged picture or a thinned picture, a plurality of gate driving signals G1, G2, G3 and so on for driving the same plurality of gate lines are set at a high level with timings different from each other. Unlike the conventional technique to display a enlarged picture, however, two adjacent gate lines do not rise to the high level at the same time. Thus, the technique provided by the embodiment can be applied to a liquid-crystal display apparatus provided with supplementary capacitors each having a Cs on-gate structure without problems. In addition, since the gate driving signals are set at the high level for period of times of the same length, no image irregularity is generated on the display unit 7.

Furthermore, in the case of the embodiment, the timings to superpose the signal CLK-2 or the signal CLK'-2 or, in other words, the timings to carry put copy or thinning operations for odd and even fields in an operation to display an enlarged picture or a thinned picture respectively are shifted from each other by two horizontal periods. Thus, in an operation to display a slanting line on the screen, for example, in no case does the line look partially thick or broken. As a result, there is exhibited an effect of a capability of obtaining a smooth picture.

Other examples of this effect are explained as follows.

Figure 4:
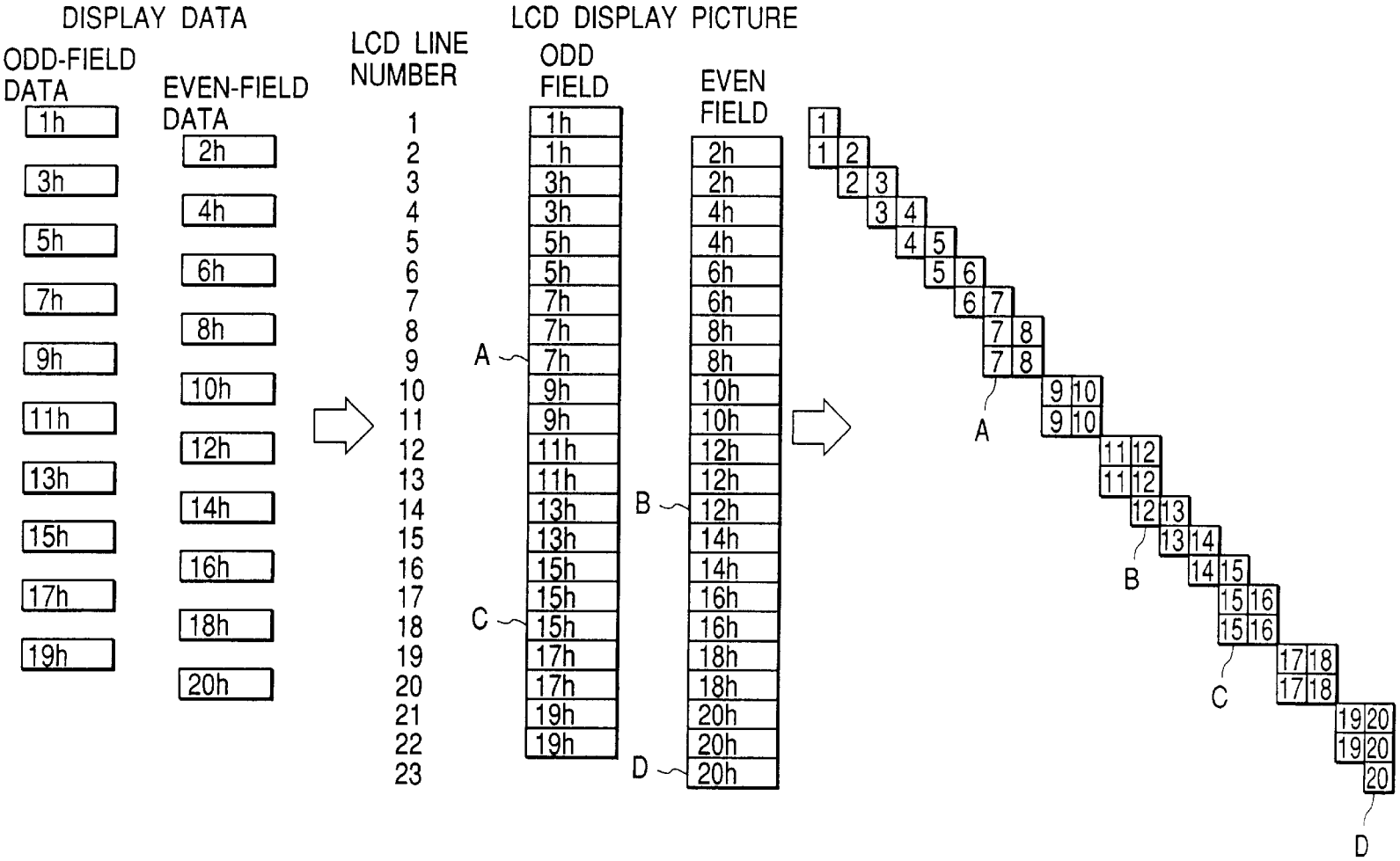
FIG. 4 is an explanatory diagram used for describing an effect of the present invention exemplified by an operation to display a video signal as an enlarged picture.
Figure 5:
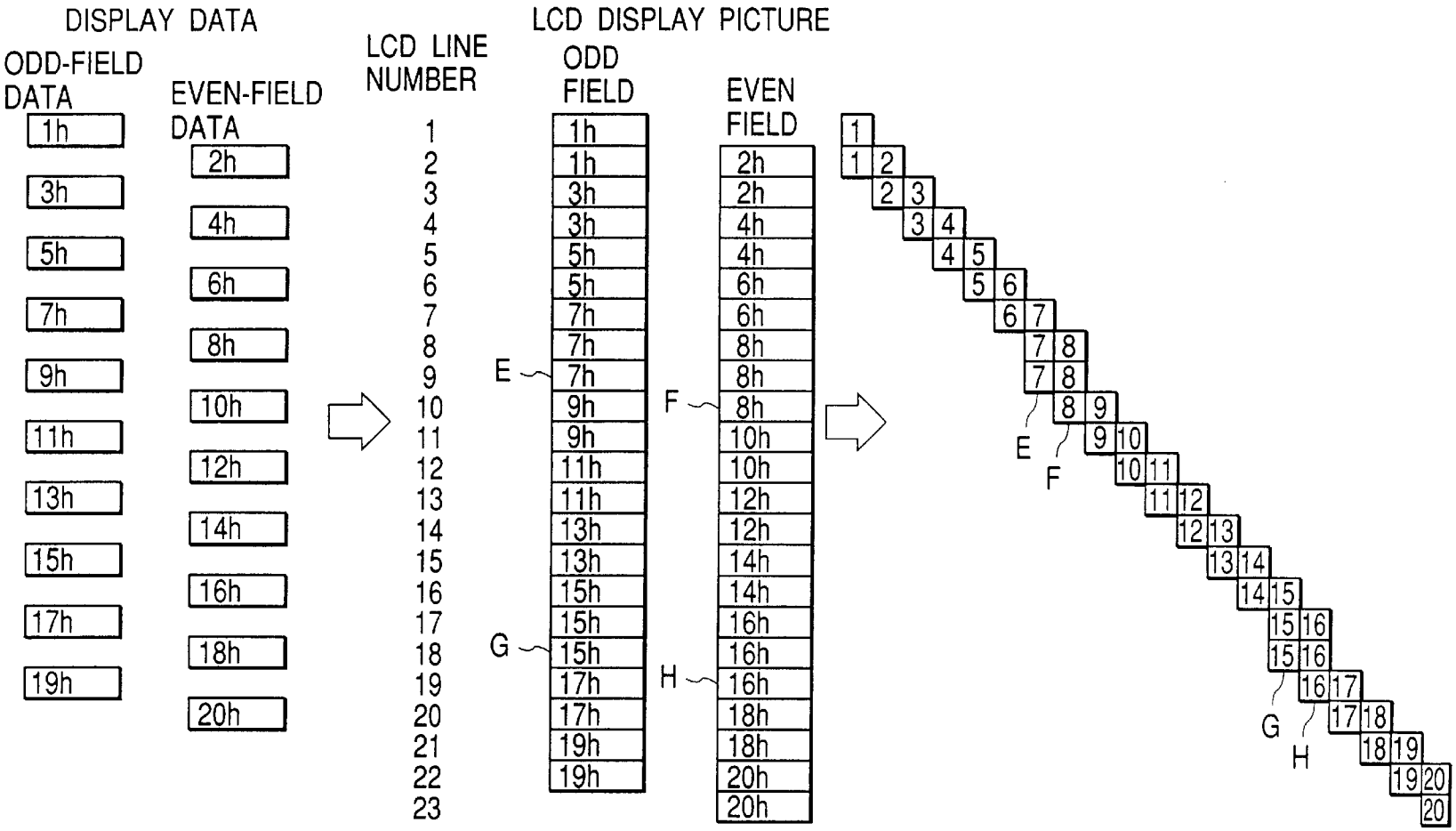
FIG. 5 is a diagram showing an example to be compared with that shown in FIG. 4.

In an operation to display an NTSC video signal on a display panel with a vertical-pixel count of 540 as an enlarged picture, for example, data of odd fields denoted by notations 1*h*, 3*h*, - - - , 19*h* and data of even fields denoted by notations 2*h*, 4*h*, - - - , 20*h* are each copied to create two identical pieces of data which are displayed on two adjacent lines respectively as shown in FIGS. 4 and 5. The operation is an ordinary operation based on the double-speed line-sequential driving.

Then, in an operation to copy data for displaying an enlarged picture at a typical rate of a line per 8 horizontal lines, data is not copied with timings separated from each other by at least two horizontal periods as is the case with the present invention. Instead, data is copied typically in two horizontal periods adjacent to each other along the time axis. An example is shown in FIG. 5. As shown in the figure, data 7*h* and data 15*h* are copied in the case of odd fields. Results of the copying of the data 7*h* and 15*h* are denoted by symbols E and G respectively. In the case of even fields, on the other hand, data 8*h* and data 16*h* are copied. Results of the copying of the data are denoted by symbols F and H respectively. Assume that the data represents a slanting line. In this case, to the eyes of the user in which odd fields and even fields are superposed on each other, a portion at the location of the data 7*h* and the data 8*h* and a portion at the location of the data 15*h* and the data 16*h* look thicker than other portions as shown on the right-hand side of FIG. 5, appearing as anon-smoothness. As a result, the picture is not seen as a natural slanting line.

In the case of the present invention, on the other hand, data for an even field is copied with timing separated from timing to copy data for another even field by at least two horizontal periods, for example, 5 horizontal periods. By the same token, data for an odd field is copied with timing separated from timing to copy data for another odd field by at least two horizontal periods, for example, 5 horizontal periods. In the case of the example shown in FIG. 4, data 7*h* and data 15*h* for odd fields are copied to result in copied pieces of data denoted by symbols A and C respectively. By the same token, data 12*h* and data 20*h* for even fields are copied to result in copied pieces of data denoted by symbols B and D respectively. Assume that the data represents a slanting line. In this case, portions which appear thicker or appear as a non-smoothness to the eyes of the user are distributed at long intervals along the time axis as shown on the right-hand side of FIG. 4. As a result, the picture is seen as a natural slanting line to a certain degree.

Figure 6:
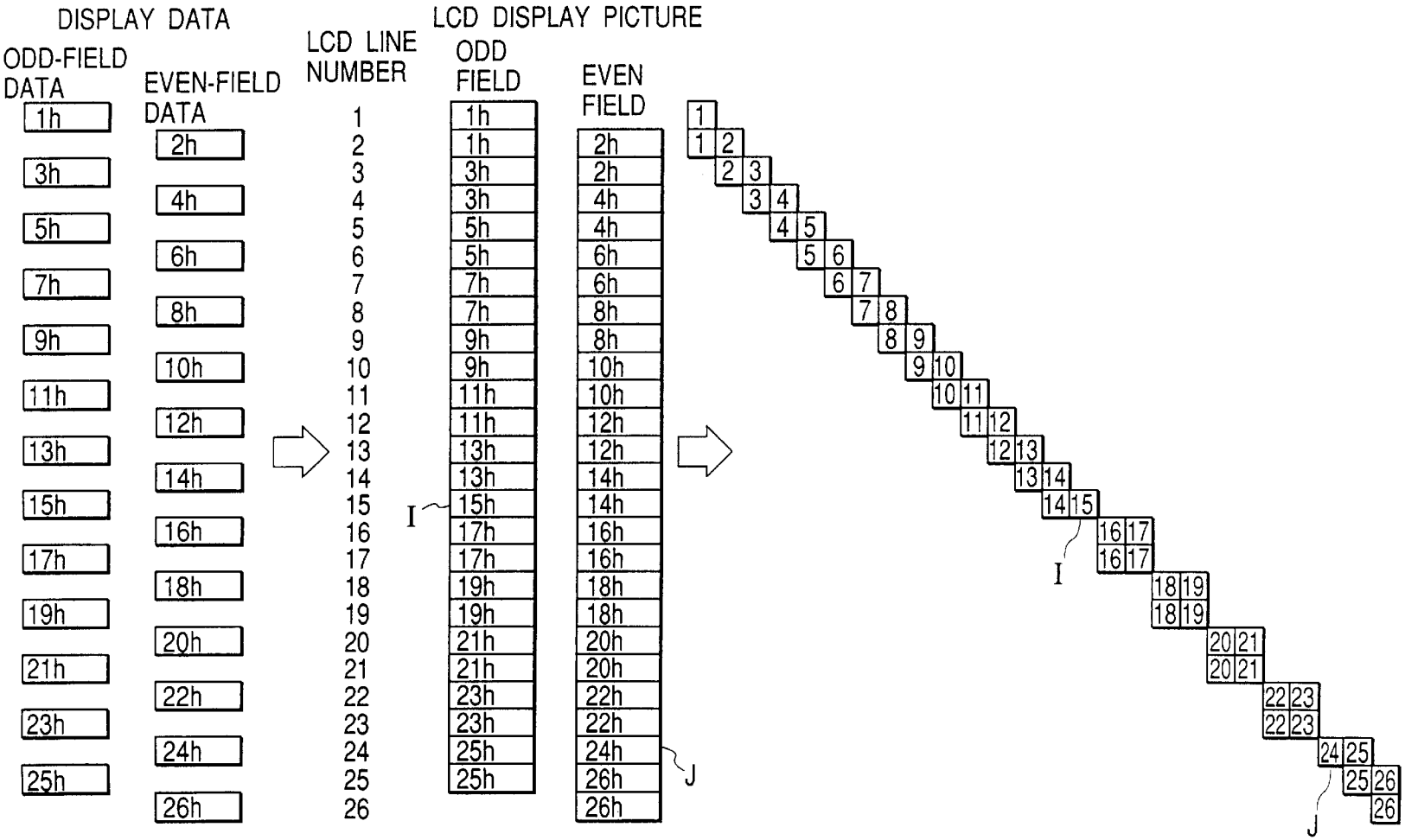
FIG. 6 is an explanatory diagram used for describing an effect of the present invention exemplified by an operation to display a video signal as a thinned picture.
Figure 7:
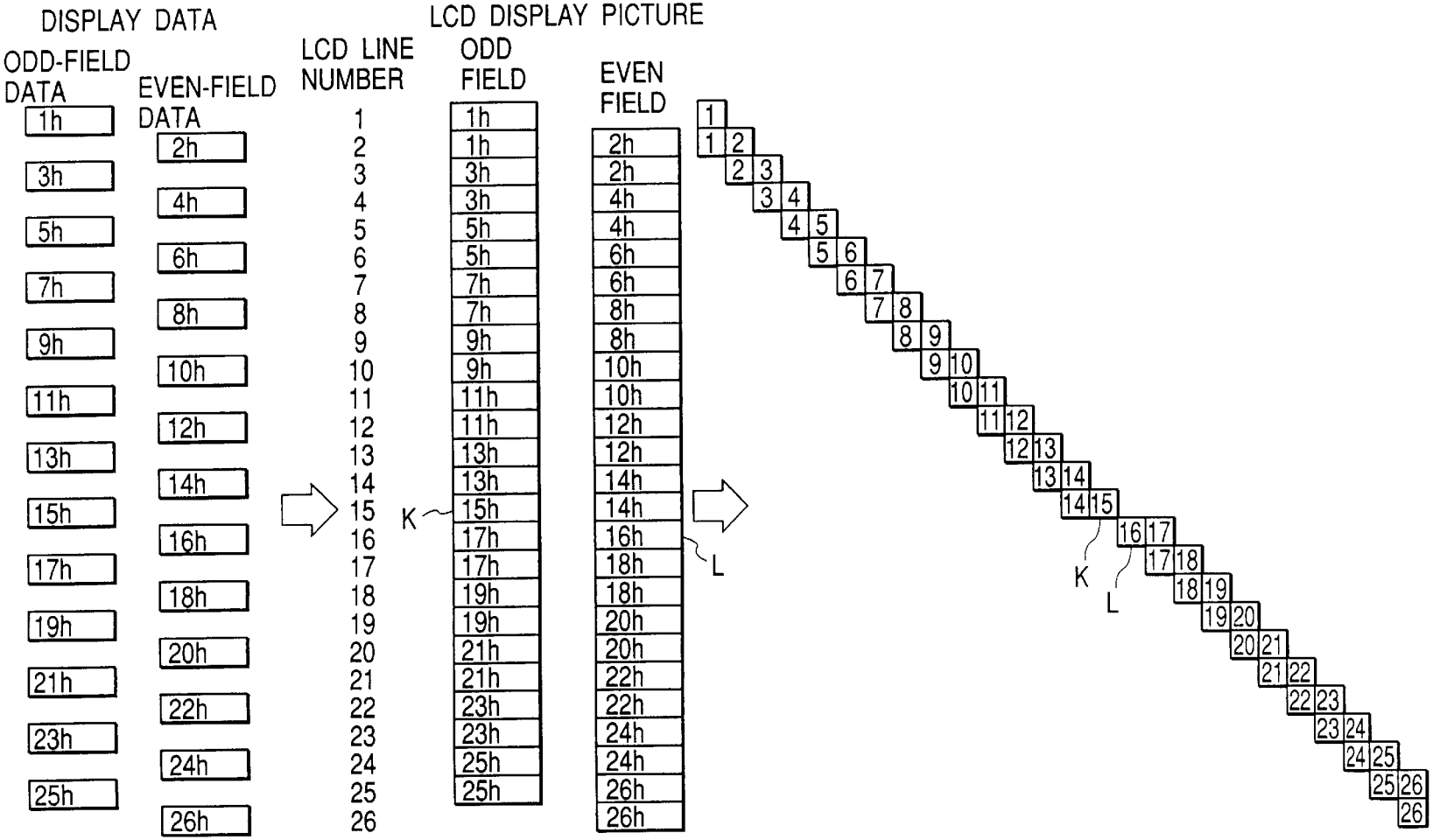
FIG. 7 is a diagram showing an example to be compared with that shown in FIG. 6.
Figure 8A:
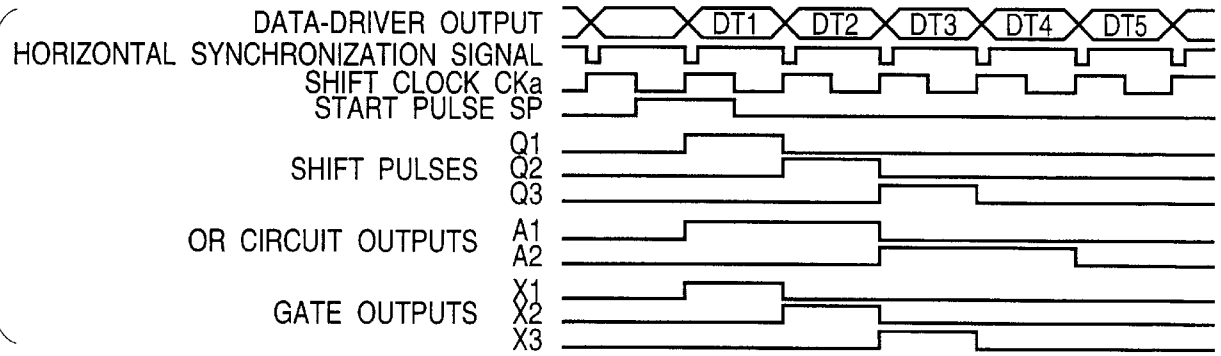
FIG. 8A PRIOR ART
FIGS. 8A and 8B are explanatory diagrams used for describing a conventional technique of displaying video signals as enlarged pictures.
Figure 8B:
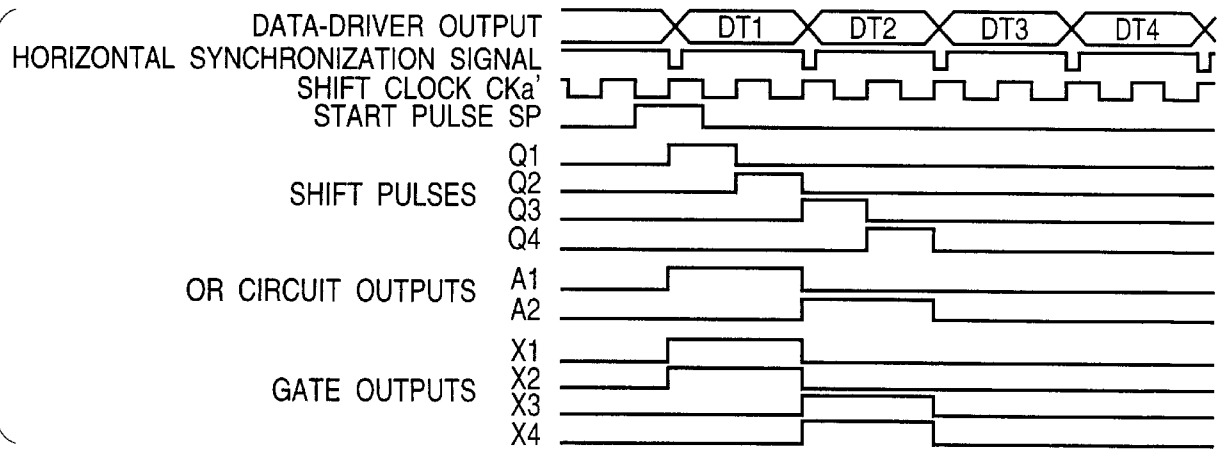
FIG. 8B PRIOR ART

In an operation to display a PAL video signal on a display panel with a vertical-pixel count of 540 as a thinned picture, the double-speed line-sequential driving system may be adopted as shown in FIGS. 6 and 7. In this case, pieces of data of odd fields denoted by notations 1*h*, 3*h*, - - - , and 19*h* and pieces of data of even fields denoted by notations 2*h*, 4*h*, - - - , and 20*h* are each copied to result in two identical pieces of data which are displayed on two adjacent horizontal lines. The operation is an ordinary operation of the double-speed line-sequential driving technique.

In an operation to carry out thinning on data at a typical rate of an eliminated line per 16 horizontal lines in order to display a shrunk picture, data is not copied with timings separated from each other by at least two horizontal periods as is the case with the present invention. Instead, data is typically thinned in horizontal line periods timewise adjacent to each other. An example of such a thinning operation is shown in FIG. 7. As shown in FIG. 7, data 15*h* of an odd field is eliminated. A location of the eliminated data is denoted by a symbol K. On the other hand, data 16*h* of an even field is eliminated. A location of the eliminated data is denoted by a symbol L. Assume that the data represents a slanting line. In this case, to the eyes of the user in which odd fields and even fields are superposed on each other, a portion at a junction between the data 15*h* and the data 16*h* looks thinner than other portions as shown on the right-hand side of FIG. 7, causing the slanting line to appear as a broken line.

In the case of the present invention, on the other hand, data for an even field is thinned with timing separated from timing to copy data for another even field by at least two horizontal periods, for example, 9 horizontal periods. By the same token, data for an odd field is thinned with timing separated from timing to copy data for another odd field by at least two horizontal periods, for example, 9 horizontal periods. In the case of the example shown in FIG. 6, data 15*h* of an odd field is eliminated. A location of the eliminated data is denoted by a symbol I. On the other hand, data 24*h* of an even field is eliminated. A location of the eliminated data is denoted by a symbol J. Assume that the data represents a slanting line. In this case, portions looking thinner to the eyes of the user are separated from each other by a long distance as shown on the right-hand side of FIG. 6, causing the slanting line to appear not as a broken line.

It should be noted that the technological scope of the present invention is not limited to the embodiment described above. A variety of changes and modifications can be made to the embodiment as long as the changes and the modifications do not depart from the range of the essence of the present invention. For example, the present invention has been exemplified by a liquid-crystal display apparatus having both the functions to display audio signals as enlarged and thinned pictures. However, it is also possible to provide a circuit configuration with only one of the functions provided that the one function is sufficient. In addition, the present invention can also be applied to a TFT-type liquid-crystal display device and a liquid-crystal display apparatus employing a ferroelectric wave crystal or an antiferroelectric wave crystal.

Effects of the Invention

As has been described above in detail, according to the display apparatus provided by the present invention, in an operation to display a video signal as an enlarged or thinned picture, a plurality of gate driving signals for driving the same plurality of gate lines are set at a high level with timings different from each other so that two adjacent gate lines are not driven to a high lines at the same time as is the case with the conventional technique to display a video signal as an enlarged picture. Thus, the technique provided by the present invention can be applied to a liquid-crystal display apparatus provided with supplementary capacitors each having a Cs on-gate structure without problems. In addition, when displaying a slanting line on a screen, for example, copying or thinning is carried out on pieces of signal data of fields in horizontal periods separated away from each other by at least two horizontal periods. Therefore, thick portions or broken portions of the line are not seen by the user. As a result, a smooth picture is obtained.

What is claimed is:

1. A display apparatus comprising a driving circuit having:

a pulse generating circuit to generate, in addition to two original clock pulse signals, second clock pulse signals for a thinning purpose with a desired timing in a desired horizontal period in an operation to display a video signal having a vertical-pixel count greater than a predetermined vertical-pixel count of a display unit as a vertically reduced picture on a screen on said display unit by using two kinds of adjacent fields by writing a video signal in a horizontal period into two adjacent gate lines of said display unit, the number of gate lines to be driven being greater than the number of gate lines of said display unit, the video signal of each of the lines in the horizontal direction being thinned out for displaying the reduced picture, the lines being positioned away from each other in the vertical direction of the video signal, the number of lines being equal to a difference between the predetermined vertical-pixel count of said display unit and a vertical-pixel count of the video signal, the two original clock pulse signals being generated in a horizontal period as required in an operation of displaying a video signal having a vertical-pixel count equal to said predetermined vertical-pixel count of said display unit, said second clock pulse signals having pulses corresponding to positions of said original clock pulse signals to be thinned, and to repeat generation of said original clock pulse signals for each horizontal period and generation of said second clock pulse signals for a desired horizontal period;

a gate-clock generating circuit to receive said original clock pulse signals and said second clock pulse signals from said pulse generating circuit and to generate gate-clock signals obtained as a result of superposing all of said original clock pulse signals on some of said second clock pulse signals wherein the number of said superposed second clock pulse signals is equal to a difference obtained as a result of subtraction of said vertical-pixel count of said display unit from said predetermined vertical-pixel count of said video signal, said second clock pulse signals being in a desired horizontal period, said gate-clock signals containing the original clock pulse signal thinned by the desired superposed second clock pulse signals and being for said two kinds of adjacent fields; and a gate driving circuit to receive said gate clock signals from said gate-clock generating circuit and to generate gate driving signals used for driving a predetermined number of gate lines as pulses of said gate clock signals for each horizontal period, wherein said gate clock signals generated from said gate-clock generating circuit cause said gate driving circuit to generate different gate driving signals for two adjacent gate lines in the same field, and wherein said display apparatus is a TFT-type liquid-crystal display apparatus.

2. A display apparatus comprising a driving circuit having:

a pulse generating circuit to generate, in addition to original clock pulse signals, second clock pulse signals for a copy purpose with a desired timing in a horizontal period in an operation to display a video signal having a vertical-pixel count smaller than a predetermined vertical-pixel count of a display unit as a vertically enlarged picture on a screen of said display unit by using two kinds of adjacent fields, the video signal of each of original lines in a horizontal direction being copied into a copied line for displaying the enlarged picture, a number of copied lines being equal to a difference between said predetermined vertical-pixel count of said display unit and a vertical-pixel count of the video signal, the copied lines being adjacent to the original lines on said display unit, the original clock pulse signals being required in an operation of displaying a video signal having a vertical-pixel count equal to said predetermined vertical-pixel count of said display unit, the second clock pulse signals being pulses which do not overlap with the original clock pulse signals, and to repeat generation of said original clock pulse signals and said second clock pulse signals for each horizontal period;

a gate-clock generating circuit to receive said original clock pulse signals and said second clock pulse signals from said pulse generating circuit and to generate gate-clock signals obtained as a result of superposing all of said original clock pulse signals on some of said second clock pulse signals wherein the number of said superposed second clock pulse signals is equal to a difference obtained as a result of subtraction of said vertical-pixel count of said video signal from said predetermined vertical-pixel count of said display unit, the second clock pulse signals being in a desired horizontal period, said gate-clock signals containing said original clock pulse signals and said superposed second clock pulse signals and being for said two kinds of adjacent fields; and a gate driving circuit to receive said gate clock signals from said gate-clock generating circuit and to generate gate driving signals used for driving a predetermined number of gate lines as pulses of said gate clock signals for each horizontal period, wherein said gate clock signals generated from said gate-clock generating circuit cause said gate driving circuit to generate different gate driving signals for two adjacent gate lines in the same field, the gate lines corresponding to the copied lines of said display unit are driven by the second clock pulse signals, which do not overlap with the original clock pulses, in the same horizontal period as the horizontal period in which the gate lines corresponding to the original lines are driven, and wherein the desired second clock pulse signals to be superposed are determined by a combination of a second clock pulse signal and an output enable signal that has been generated from a latch circuit and inverted.

3. A display apparatus comprising a driving circuit having:

a pulse generating circuit to generate, in addition to original clock pulse signals, second clock pulse signals for a copy purpose with a desired timing in a horizontal period in an operation to display a video signal having a vertical-pixel count smaller than a predetermined vertical-pixel count of a display unit as a vertically enlarged picture on a screen of said display unit by using two kinds of adjacent fields, the video signal of each of original lines in a horizontal direction being copied into a copied line for displaying the enlarged picture, a number of copied lines being equal to a difference between said predetermined vertical-pixel count of said display unit and a vertical-pixel count of the video signal, the copied lines being adjacent to the original lines on said display unit, the original clock pulse signals being required in an operation of displaying a video signal having a vertical-pixel count equal to said predetermined vertical-pixel count of said display unit, the second clock pulse signals being pulses which do not overlap with the original clock pulse signals, and to repeat generation of said original clock pulse signals and said second clock pulse signals for each horizontal period;

a gate-clock generating circuit to receive said original clock pulse signals and said second clock pulse signals from said pulse generating circuit and to generate gate-clock signals obtained as a result of superposing all of said original clock pulse signals on some of said second clock pulse signals wherein the number of said superposed second clock pulse signals is equal to a difference obtained as a result of subtraction of said vertical-pixel count of said video signal from said predetermined vertical-pixel count of said display unit, the second clock pulse signals being in a desired horizontal period, said gate-clock signals containing said original clock pulse signals and said superposed second clock pulse signals and being for said two kinds of adjacent fields; and a gate driving circuit to receive said gate clock signals from said gate-clock generating circuit and to generate gate driving signals used for driving a predetermined number of gate lines as pulses of said gate clock signals for each horizontal period, wherein said gate clock signals generated from said gate-clock generating circuit cause said gate driving circuit to generate different gate driving signals for two adjacent gate lines in the same field, the gate lines corresponding to the copied lines of said display unit are driven by the second clock pulse signals, which do not overlap with the original clock pulses, in the same horizontal period as the horizontal period in which the gate lines corresponding to the original lines are driven , and wherein the second clock pulse signals are superposed such that the second clock pulse signals are generated in the two kinds of adjacent fields shifted from each other by at least one horizontal period.

4. A display apparatus according to claim 2, wherein the output enable signals generated for the two kinds of adjacent fields overlap in at least one horizontal period.

5. A display apparatus according to claim 2, wherein in at least one set of horizontal periods: the output enable signals generated for one of the two kinds of adjacent fields are generated in three successive horizontal periods and the output enable signals generated for the other of the two kinds of adjacent fields are generated in at least one pair of successive horizontal periods in which one of the output enable signals generated in the pair of successive horizontal periods overlaps with one of the output enable signals generated in the three successive horizontal periods.

6. A display apparatus according to claim 2, wherein none of the output enable signals overlap any of the original clock pulses.

7. A display apparatus comprising a driving circuit having:

a pulse generating circuit to generate, in addition to original clock pulse signals, second clock pulse signals for a copy purpose with a desired timing in a horizontal period in an operation to display a video signal having a vertical-pixel count smaller than a predetermined vertical-pixel count of a display unit as a vertically enlarged picture on a screen of said display unit by using two kinds of adjacent fields, the video signal of each of original lines in a horizontal direction being copied into a copied line for displaying the enlarged picture, a number of copied lines being equal to a difference between said predetermined vertical-pixel count of said display unit and a vertical-pixel count of the video signal, the copied lines being adjacent to the original lines on said display unit, the original clock pulse signals being required in an operation of displaying a video signal having a vertical-pixel count equal to said predetermined vertical-pixel count of said display unit, the second clock pulse signals being pulses which do not overlap with the original clock pulse signals, and to repeat generation of said original clock pulse signals and said second clock pulse signals for each horizontal period;

a gate-clock generating circuit to receive said original clock pulse signals and said second clock pulse signals from said pulse generating circuit and to generate gate-clock signals obtained as a result of superposing all of said original clock pulse signals on some of said second clock pulse signals wherein the number of said superposed second clock pulse signals is equal to a difference obtained as a result of subtraction of said vertical-pixel count of said video signal from said predetermined vertical-pixel count of said display unit, the second clock pulse signals being in a desired horizontal period, said gate-clock signals containing said original clock pulse signals and said superposed second clock pulse signals and being for said two kinds of adjacent fields; and a gate driving circuit to receive said gate clock signals from said gate-clock generating circuit and to generate gate driving signals used for driving a predetermined number of gate lines as pulses of said gate clock signals for each horizontal period, wherein said gate clock signals generated from said gate-clock generating circuit cause said gate driving circuit to generate different gate driving signals for two adjacent gate lines in the same field, the gate lines corresponding to the copied lines of said display unit are driven by the second clock pulse signals, which do not overlap with the original clock pulses, in the same horizontal period as the horizontal period in which the gate lines corresponding to the original lines are driven , and wherein the original clock pulse signals are generated during the first ⅔ of each horizontal period and the second clock pulse signals are generated during the last ⅓ of each horizontal period.

8. A display apparatus comprising a driving circuit having:

a pulse generating circuit to generate, in addition to two original clock pulse signals, second clock pulse signals for a thinning purpose with a desired timing in a desired horizontal period in an operation to display a video signal having a vertical-pixel count greater than a predetermined vertical-pixel count of a display unit as a vertically reduced picture on a screen on said display unit by using two kinds of adjacent fields by writing a video signal in a horizontal period into two adjacent gate lines of said display unit, the number of gate lines to be driven being greater than the number of gate lines of said display unit, the video signal of each of the lines in the horizontal direction being thinned out for displaying the reduced picture, the lines being positioned away from each other in the vertical direction of the video signal, the number of lines being equal to a difference between the predetermined vertical-pixel count of said display unit and a vertical-pixel count of the video signal, the two original clock pulse signals being generated in a horizontal period as required in an operation of displaying a video signal having a vertical-pixel count equal to said predetermined vertical-pixel count of said display unit, said second clock pulse signals having pulses corresponding to positions of said original clock pulse signals to be thinned, and to repeat generation of said original clock pulse signals for each horizontal period and generation of said second clock pulse signals for a desired horizontal period;

a gate-clock generating circuit to receive said original clock pulse signals and said second clock pulse signals from said pulse generating circuit and to generate gate-clock signals obtained as a result of superposing all of said original clock pulse signals on some of said second clock pulse signals wherein the number of said superposed second clock pulse signals is equal to a difference obtained as a result of subtraction of said vertical-pixel count of said display unit from said predetermined vertical-pixel count of said video signal, said second clock pulse signals being in a desired horizontal period, said gate-clock signals containing the original clock pulse signal thinned by the desired superposed second clock pulse signals and being for said two kinds of adjacent fields; and a gate driving circuit to receive said gate clock signals from said gate-clock generating circuit and to generate gate driving signals used for driving a predetermined number of gate lines as pulses of said gate clock signals for each horizontal period, wherein said gate clock signals generated from said gate-clock generating circuit cause said gate driving circuit to generate different gate driving signals for two adjacent gate lines in the same field and the second clock pulse signals are superposed such that the superposed second clock pulse signals generated in the two kinds of adjacent fields are shifted from each other by at least one horizontal period.

9. A display apparatus comprising a driving circuit having:

a pulse generating circuit to generate, in addition to two original clock pulse signals, second clock pulse signals for a thinning purpose with a desired timing in a desired horizontal period in an operation to display a video signal having a vertical-pixel count greater than a predetermined vertical-pixel count of a display unit as a vertically reduced picture on a screen on said display unit by using two kinds of adjacent fields by writing a video signal in a horizontal period into two adjacent gate lines of said display unit, the number of gate lines to be driven being greater than the number of gate lines of said display unit, the video signal of each of the lines in the horizontal direction being thinned out for displaying the reduced picture, the lines being positioned away from each other in the vertical direction of the video signal, the number of lines being equal to a difference between the predetermined vertical-pixel count of said display unit and a vertical-pixel count of the video signal, the two original clock pulse signals being generated in a horizontal period as required in an operation of displaying a video signal having a vertical-pixel count equal to said predetermined vertical-pixel count of said display unit, said second clock pulse signals having pulses corresponding to positions of said original clock pulse signals to be thinned, and to repeat generation of said original clock pulse signals for each horizontal period and generation of said second clock pulse signals for a desired horizontal period;

a gate-clock generating circuit to receive said original clock pulse signals and said second clock pulse signals from said pulse generating circuit and to generate gate-clock signals obtained as a result of superposing all of said original clock pulse signals on some of said second clock pulse signals wherein the number of said superposed second clock pulse signals is equal to a difference obtained as a result of subtraction of said vertical-pixel count of said display unit from said predetermined vertical-pixel count of said video signal, said second clock pulse signals being in a desired horizontal period, said gate-clock signals containing the original clock pulse signal thinned by the desired superposed second clock pulse signals and being for said two kinds of adjacent fields; and a gate driving circuit to receive said gate clock signals from said gate-clock generating circuit and to generate gate driving signals used for driving a predetermined number of gate lines as pulses of said gate clock signals for each horizontal period, wherein said gate clock signals generated from said gate-clock generating circuit cause said gate driving circuit to generate different gate driving signals for two adjacent gate lines in the same field and one second clock pulse signal is generated every other horizontal period and successive second clock pulse signals are generated in leading portions and intermediate portions of the horizontal periods.

10. A display apparatus comprising a driving circuit having:

a pulse generating circuit to generate, in addition to two original clock pulse signals, second clock pulse signals for a thinning purpose with a desired timing in a desired horizontal period in an operation to display a video signal having a vertical-pixel count greater than a predetermined vertical-pixel count of a display unit as a vertically reduced picture on a screen on said display unit by using two kinds of adjacent fields by writing a video signal in a horizontal period into two adjacent gate lines of said display unit, the number of gate lines to be driven being greater than the number of gate lines of said display unit, the video signal of each of the lines in the horizontal direction being thinned out for displaying the reduced picture, the lines being positioned away from each other in the vertical direction of the video signal, the number of lines being equal to a difference between the predetermined vertical-pixel count of said display unit and a vertical-pixel count of the video signal, the two original clock pulse signals being generated in a horizontal period as required in an operation of displaying a video signal having a vertical-pixel count equal to said predetermined vertical-pixel count of said display unit, said second clock pulse signals having pulses corresponding to positions of said original clock pulse signals to be thinned, and to repeat generation of said original clock pulse signals for each horizontal period and generation of said second clock pulse signals for a desired horizontal period;

a gate-clock generating circuit to receive said original clock pulse signals and said second clock pulse signals from said pulse generating circuit and to generate gate-clock signals obtained as a result of superposing all of said original clock pulse signals on some of said second clock pulse signals wherein the number of said superposed second clock pulse signals is equal to a difference obtained as a result of subtraction of said vertical-pixel count of said display unit from said predetermined vertical-pixel count of said video signal, said second clock pulse signals being in a desired horizontal period, said gate-clock signals containing the original clock pulse signal thinned by the desired superposed second clock pulse signals and being for said two kinds of adjacent fields; and a gate driving circuit to receive said gate clock signals from said gate-clock generating circuit and to generate gate driving signals used for driving a predetermined number of gate lines as pulses of said gate clock signals for each horizontal period, wherein said gate clock signals generated from said gate-clock generating circuit cause said gate driving circuit to generate different gate driving signals for two adjacent gate lines in the same field and the desired second clock pulse signals to be superposed are determined by a combination of a second clock pulse signal and an output enable signal that has been generated from a latch circuit and inverted.

11. A display apparatus according to claim 10, wherein the output enable signals generated for the two kinds of adjacent fields do not overlap in any horizontal period.

12. A display apparatus according to claim 10, wherein each of the output enable signals overlap a different original clock pulse.

13. A display apparatus comprising a driving circuit having:

a first pulse generating circuit to generate a first set of second clock pulse signals for a copy purpose with a desired timing in a horizontal period in an operation to display a first video signal having a vertical-pixel count smaller than a predetermined vertical-pixel count of a display unit as an enlarged picture on a screen of the display unit by using two kinds of adjacent fields in addition to as many original clock pulse signals as required in an operation of displaying a video signal having a vertical-pixel count equal to the predetermined vertical-pixel count of the display unit, the first set of second clock pulse signals being pulses which do not overlap with the original clock pulse signals, and to repeat generation of the original clock pulse signals and the first set of second clock pulse signals for each horizontal period;

a first gate-clock generating circuit to receive the original clock pulse signals and the first set of second clock pulse signals from the first pulse generating circuit and to generate first gate-clock signals obtained as a result of superposing all of the original clock pulse signals on some of the first set of second clock pulse signals wherein the number of the superposed first set of second clock pulse signals is equal to a difference obtained as a result of subtraction of the vertical-pixel count of the first video signal from the predetermined vertical-pixel count of the display unit, the first set of second clock pulse signals being in a desired horizontal period, the first gate-clock signals containing the original clock pulse signals and the superposed first set of second clock pulse signals and being for the two kinds of adjacent fields; and a first gate driving circuit to receive the first gate clock signals from the first gate-clock generating circuit and to generate first gate driving signals used for driving a predetermined number of gate lines as pulses of the first gate clock signals for each horizontal period, wherein the first gate clock signals generated from the first gate-clock generating circuit cause the first gate driving circuit to generate the different first gate driving signals for two adjacent gate lines in the same field, a second pulse generating circuit to display the screen on the display unit by using the two kinds of adjacent fields by writing a video signal in a horizontal period into two adjacent gate lines of the display unit wherein, in an operation to display a second video signal having a second vertical-pixel count greater than the predetermined vertical-pixel count of the display unit, the second video signal is thinned by generating a second set of second clock pulse signals for a thinning purpose with a desired timing in a desired horizontal period in addition to two original clock pulse signals generated in a horizontal period as required in an operation of displaying the video signal having the vertical-pixel count equal to the predetermined vertical-pixel count of the display unit, the second set of second clock pulse signals having pulses corresponding to positions of the original clock pulse signals to be thinned, and by repeating generation of the original clock pulse signals for each horizontal period and generation of the second set of second clock pulse signals for a desired horizontal period;

a second gate-clock generating circuit to receive the original clock pulse signals and the second set of second clock pulse signals from the second pulse generating circuit and to generate second gate-clock signals obtained as a result of superposing all of the original clock pulse signals on some of the second set of second clock pulse signals wherein the number of the superposed second set of second clock pulse signals is equal to a difference obtained as a result of subtraction of the second vertical-pixel count of the display unit from the predetermined vertical-pixel count of the video signal, the second set of second clock pulse signals being in a desired horizontal period, the second gate-clock signals containing the original clock pulse signal thinned by the desired superposed second set of second clock pulse signals and being for the two kinds of adjacent fields; and a second gate driving circuit to receive the second gate clock signals from the second gate-clock generating circuit and to generate second gate driving signals used for driving a predetermined number of gate lines as pulses of the second gate clock signals for each horizontal period, wherein the second gate clock signals generated from the second gate-clock generating circuit cause the second gate driving circuit to generate the different second gate driving signals for two adjacent gate lines in the same field, and wherein the desired first and second set of second clock pulse signals to be superposed are determined by a combination of a second clock pulse signal of the first and second set of second clock pulse signals and a first and second set of output enable signals that have been generated from a latch circuit and inverted, respectively.

14. A display apparatus comprising a driving circuit having:

a first pulse generating circuit to generate a first set of second clock pulse signals for a copy purpose with a desired timing in a horizontal period in an operation to display a first video signal having a vertical-pixel count smaller than a predetermined vertical-pixel count of a display unit as an enlarged picture on a screen of the display unit by using two kinds of adjacent fields in addition to as many original clock pulse signals as required in an operation of displaying a video signal having a vertical-pixel count equal to the predetermined vertical-pixel count of the display unit, the first set of second clock pulse signals being pulses which do not overlap with the original clock pulse signals, and to repeat generation of the original clock pulse signals and the first set of second clock pulse signals for each horizontal period;

a first gate-clock generating circuit to receive the original clock pulse signals and the first set of second clock pulse signals from the first pulse generating circuit and to generate first gate-clock signals obtained as a result of superposing all of the original clock pulse signals on some of the first set of second clock pulse signals wherein the number of the superposed first set of second clock pulse signals is equal to a difference obtained as a result of subtraction of the vertical-pixel count of the first video signal from the predetermined vertical-pixel count of the display unit, the first set of second clock pulse signals being in a desired horizontal period, the first gate-clock signals containing the original clock pulse signals and the superposed first set of second clock pulse signals and being for the two kinds of adjacent fields; and a first gate driving circuit to receive the first gate clock signals from the first gate-clock generating circuit and to generate first gate driving signals used for driving a predetermined number of gate lines as pulses of the first gate clock signals for each horizontal period, wherein the first gate clock signals generated from the first gate-clock generating circuit cause the first gate driving circuit to generate the different first gate driving signals for two adjacent gate lines in the same field, a second pulse generating circuit to display the screen on the display unit by using the two kinds of adjacent fields by writing a video signal in a horizontal period into two adjacent gate lines of the display unit wherein, in an operation to display a second video signal having a second vertical-pixel count greater than the predetermined vertical-pixel count of the display unit, the second video signal is thinned by generating a second set of second clock pulse signals for a thinning purpose with a desired timing in a desired horizontal period in addition to two original clock pulse signals generated in a horizontal period as required in an operation of displaying the video signal having the vertical-pixel count equal to the predetermined vertical-pixel count of the display unit, the second set of second clock pulse signals having pulses corresponding to positions of the original clock pulse signals to be thinned, and by repeating generation of the original clock pulse signals for each horizontal period and generation of the second set of second clock pulse signals for a desired horizontal period;

a second gate-clock generating circuit to receive the original clock pulse signals and the second set of second clock pulse signals from the second pulse generating circuit and to generate second gate-clock signals obtained as a result of superposing all of the original clock pulse signals on some of the second set of second clock pulse signals wherein the number of the superposed second set of second clock pulse signals is equal to a difference obtained as a result of subtraction of the second vertical-pixel count of the display unit from the predetermined vertical-pixel count of the video signal, the second set of second clock pulse signals being in a desired horizontal period, the second gate-clock signals containing the original clock pulse signal thinned by the desired superposed second set of second clock pulse signals and being for the two kinds of adjacent fields; and a second gate driving circuit to receive the second gate clock signals from the second gate-clock generating circuit and to generate second gate driving signals used for driving a predetermined number of gate lines as pulses of the second gate clock signals for each horizontal period, wherein the second gate clock signals generated from the second gate-clock generating circuit cause the second gate driving circuit to generate the different second gate driving signals for two adjacent gate lines in the same field, and wherein the first set of second clock pulse signals are superposed such that the superposed first set of second clock pulse signals are generated in the two kinds of adjacent fields shifted from each other by at least one horizontal period.

15. A display apparatus according to claim 13, wherein the second set of output enable signals generated for the two kinds of adjacent fields overlap in at least one horizontal period.

16. A display apparatus according to claim 13, wherein the first set of output enable signals generated for the two kinds of adjacent fields do not overlap in any horizontal period.

17. A display apparatus according to claim 13, wherein in at least one set of horizontal periods: the first set of output enable signals generated for one of the two kinds of adjacent fields are generated in three successive horizontal periods and the first set of output enable signals generated for the other of the two kinds of adjacent fields are generated in at least one pair of successive horizontal periods in which one of the first set of output enable signals generated in the pair of successive horizontal periods overlaps with one of the first set of output enable signals generated in the three successive horizontal periods.

18. A display apparatus according to claim 13, wherein each of the second set of output enable signals overlap a different original clock pulse.

19. A display apparatus according to claim 13, wherein none of the first set of output enable signals overlap any of the original clock pulses.

20. A display apparatus comprising a driving circuit having:

a first pulse generating circuit to generate a first set of second clock pulse signals for a copy purpose with a desired timing in a horizontal period in an operation to display a first video signal having a vertical-pixel count smaller than a predetermined vertical-pixel count of a display unit as an enlarged picture on a screen of the display unit by using two kinds of adjacent fields in addition to as many original clock pulse signals as required in an operation of displaying a video signal having a vertical-pixel count equal to the predetermined vertical-pixel count of the display unit, the first set of second clock pulse signals being pulses which do not overlap with the original clock pulse signals, and to repeat generation of the original clock pulse signals and the first set of second clock pulse signals for each horizontal period;

a first gate-clock generating circuit to receive the original clock pulse signals and the first set of second clock pulse signals from the first pulse generating circuit and to generate first gate-clock signals obtained as a result of superposing all of the original clock pulse signals on some of the first set of second clock pulse signals wherein the number of the superposed first set of second clock pulse signals is equal to a difference obtained as a result of subtraction of the vertical-pixel count of the first video signal from the predetermined vertical-pixel count of the display unit, the first set of second clock pulse signals being in a desired horizontal period, the first gate-clock signals containing the original clock pulse signals and the superposed first set of second clock pulse signals and being for the two kinds of adjacent fields; and a first gate driving circuit to receive the first gate clock signals from the first gate-clock generating circuit and to generate first gate driving signals used for driving a predetermined number of gate lines as pulses of the first gate clock signals for each horizontal period, wherein the first gate clock signals generated from the first gate-clock generating circuit cause the first gate driving circuit to generate the different first gate driving signals for two adjacent gate lines in the same field, a second pulse generating circuit to display the screen on the display unit by using the two kinds of adjacent fields by writing a video signal in a horizontal period into two adjacent gate lines of the display unit wherein, in an operation to display a second video signal having a second vertical-pixel count greater than the predetermined vertical-pixel count of the display unit, the second video signal is thinned by generating a second set of second clock pulse signals for a thinning purpose with a desired timing in a desired horizontal period in addition to two original clock pulse signals generated in a horizontal period as required in an operation of displaying the video signal having the vertical-pixel count equal to the predetermined vertical-pixel count of the display unit, the second set of second clock pulse signals having pulses corresponding to positions of the original clock pulse signals to be thinned, and by repeating generation of the original clock pulse signals for each horizontal period and generation of the second set of second clock pulse signals for a desired horizontal period;

a second gate-clock generating circuit to receive the original clock pulse signals and the second set of second clock pulse signals from the second pulse generating circuit and to generate second gate-clock signals obtained as a result of superposing all of the original clock pulse signals on some of the second set of second clock pulse signals wherein the number of the superposed second set of second clock pulse signals is equal to a difference obtained as a result of subtraction of the second vertical-pixel count of the display unit from the predetermined vertical-pixel count of the video signal, the second set of second clock pulse signals being in a desired horizontal period, the second gate-clock signals containing the original clock pulse signal thinned by the desired superposed second set of second clock pulse signals and being for the two kinds of adjacent fields; and a second gate driving circuit to receive the second gate clock signals from the second gate-clock generating circuit and to generate second gate driving signals used for driving a predetermined number of gate lines as pulses of the second gate clock signals for each horizontal period, wherein the second gate clock signals generated from the second gate-clock generating circuit cause the second gate driving circuit to generate the different second gate driving signals for two adjacent gate lines in the same field, and wherein the original clock pulse signals are generated during the first ⅔ of each horizontal period and the first set of second clock pulse signals are generated during the last ⅓ of each horizontal period.

21. A display apparatus comprising a driving circuit having:

a first pulse generating circuit to generate a first set of second clock pulse signals for a copy purpose with a desired timing in a horizontal period in an operation to display a first video signal having a vertical-pixel count smaller than a predetermined vertical-pixel count of a display unit as an enlarged picture on a screen of the display unit by using two kinds of adjacent fields in addition to as many original clock pulse signals as required in an operation of displaying a video signal having a vertical-pixel count equal to the predetermined vertical-pixel count of the display unit, the first set of second clock pulse signals being pulses which do not overlap with the original clock pulse signals, and to repeat generation of the original clock pulse signals and the first set of second clock pulse signals for each horizontal period;

a first gate-clock generating circuit to receive the original clock pulse signals and the first set of second clock pulse signals from the first pulse generating circuit and to generate first gate-clock signals obtained as a result of superposing all of the original clock pulse signals on some of the first set of second clock pulse signals wherein the number of the superposed first set of second clock pulse signals is equal to a difference obtained as a result of subtraction of the vertical-pixel count of the first video signal from the predetermined vertical-pixel count of the display unit, the first set of second clock pulse signals being in a desired horizontal period, the first gate-clock signals containing the original clock pulse signals and the superposed first set of second clock pulse signals and being for the two kinds of adjacent fields; and a first gate driving circuit to receive the first gate clock signals from the first gate-clock generating circuit and to generate first gate driving signals used for driving a predetermined number of gate lines as pulses of the first gate clock signals for each horizontal period, wherein the first gate clock signals generated from the first gate-clock generating circuit cause the first gate driving circuit to generate the different first gate driving signals for two adjacent gate lines in the same field, a second pulse generating circuit to display the screen on the display unit by using the two kinds of adjacent fields by writing a video signal in a horizontal period into two adjacent gate lines of the display unit wherein, in an operation to display a second video signal having a second vertical-pixel count greater than the predetermined vertical-pixel count of the display unit, the second video signal is thinned by generating a second set of second clock pulse signals for a thinning purpose with a desired timing in a desired horizontal period in addition to two original clock pulse signals generated in a horizontal period as required in an operation of displaying the video signal having the vertical-pixel count equal to the predetermined vertical-pixel count of the display unit, the second set of second clock pulse signals having pulses corresponding to positions of the original clock pulse signals to be thinned, and by repeating generation of the original clock pulse signals for each horizontal period and generation of the second set of second clock pulse signals for a desired horizontal period;

a second gate-clock generating circuit to receive the original clock pulse signals and the second set of second clock pulse signals from the second pulse generating circuit and to generate second gate-clock signals obtained as a result of superposing all of the original clock pulse signals on some of the second set of second clock pulse signals wherein the number of the superposed second set of second clock pulse signals is equal to a difference obtained as a result of subtraction of the second vertical-pixel count of the display unit from the predetermined vertical-pixel count of the video signal, the second set of second clock pulse signals being in a desired horizontal period, the second gate-clock signals containing the original clock pulse signal thinned by the desired superposed second set of second clock pulse signals and being for the two kinds of adjacent fields; and a second gate driving circuit to receive the second gate clock signals from the second gate-clock generating circuit and to generate second gate driving signals used for driving a predetermined number of gate lines as pulses of the second gate clock signals for each horizontal period, wherein the second gate clock signals generated from the second gate-clock generating circuit cause the second gate driving circuit to generate the different second gate driving signals for two adjacent gate lines in the same field, and wherein the second set of second clock pulse signals are superposed such that the superposed second set of second clock pulse signals generated in the two kinds of adjacent fields are shifted from each other by at least one horizontal period.

22. A display apparatus comprising a driving circuit having:

a first pulse generating circuit to generate a first set of second clock pulse signals for a copy purpose with a desired timing in a horizontal period in an operation to display a first video signal having a vertical-pixel count smaller than a predetermined vertical-pixel count of a display unit as an enlarged picture on a screen of the display unit by using two kinds of adjacent fields in addition to as many original clock pulse signals as required in an operation of displaying a video signal having a vertical-pixel count equal to the predetermined vertical-pixel count of the display unit, the first set of second clock pulse signals being pulses which do not overlap with the original clock pulse signals, and to repeat generation of the original clock pulse signals and the first set of second clock pulse signals for each horizontal period;

a first gate-clock generating circuit to receive the original clock pulse signals and the first set of second clock pulse signals from the first pulse generating circuit and to generate first gate-clock signals obtained as a result of superposing all of the original clock pulse signals on some of the first set of second clock pulse signals wherein the number of the superposed first set of second clock pulse signals is equal to a difference obtained as a result of subtraction of the vertical-pixel count of the first video signal from the predetermined vertical-pixel count of the display unit, the first set of second clock pulse signals being in a desired horizontal period, the first gate-clock signals containing the original clock pulse signals and the superposed first set of second clock pulse signals and being for the two kinds of adjacent fields; and a first gate driving circuit to receive the first gate clock signals from the first gate-clock generating circuit and to generate first gate driving signals used for driving a predetermined number of gate lines as pulses of the first gate clock signals for each horizontal period, wherein the first gate clock signals generated from the first gate-clock generating circuit cause the first gate driving circuit to generate the different first gate driving signals for two adjacent gate lines in the same field, a second pulse generating circuit to display the screen on the display unit by using the two kinds of adjacent fields by writing a video signal in a horizontal period into two adjacent gate lines of the display unit wherein, in an operation to display a second video signal having a second vertical-pixel count greater than the predetermined vertical-pixel count of the display unit, the second video signal is thinned by generating a second set of second clock pulse signals for a thinning purpose with a desired timing in a desired horizontal period in addition to two original clock pulse signals generated in a horizontal period as required in an operation of displaying the video signal having the vertical-pixel count equal to the predetermined vertical-pixel count of the display unit, the second set of second clock pulse signals having pulses corresponding to positions of the original clock pulse signals to be thinned, and by repeating generation of the original clock pulse signals for each horizontal period and generation of the second set of second clock pulse signals for a desired horizontal period;

a second gate-clock generating circuit to receive the original clock pulse signals and the second set of second clock pulse signals from the second pulse generating circuit and to generate second gate-clock signals obtained as a result of superposing all of the original clock pulse signals on some of the second set of second clock pulse signals wherein the number of the superposed second set of second clock pulse signals is equal to a difference obtained as a result of subtraction of the second vertical-pixel count of the display unit from the predetermined vertical-pixel count of the video signal, the second set of second clock pulse signals being in a desired horizontal period, the second gate-clock signals containing the original clock pulse signal thinned by the desired superposed second set of second clock pulse signals and being for the two kinds of adjacent fields; and a second gate driving circuit to receive the second gate clock signals from the second gate-clock generating circuit and to generate second gate driving signals used for driving a predetermined number of gate lines as pulses of the second gate clock signals for each horizontal period, wherein the second gate clock signals generated from the second gate-clock generating circuit cause the second gate driving circuit to generate the different second gate driving signals for two adjacent gate lines in the same field, and wherein one of the second set of second clock pulse signals is generated every other horizontal period and successive second clock pulse signals of the second set of second clock pulse signals are generated in leading portions and intermediate portions of the horizontal periods.

23. A display apparatus comprising a driving circuit having:

a first pulse generating circuit to generate a first set of second clock pulse signals for a copy purpose with a desired timing in a horizontal period in an operation to display a first video signal having a vertical-pixel count smaller than a predetermined vertical-pixel count of a display unit as an enlarged picture on a screen of the display unit by using two kinds of adjacent fields in addition to as many original clock pulse signals as required in an operation of displaying a video signal having a vertical-pixel count equal to the predetermined vertical-pixel count of the display unit, the first set of second clock pulse signals being pulses which do not overlap with the original clock pulse signals, and to repeat generation of the original clock pulse signals and the first set of second clock pulse signals for each horizontal period;

a first gate-clock generating circuit to receive the original clock pulse signals and the first set of second clock pulse signals from the first pulse generating circuit and to generate first gate-clock signals obtained as a result of superposing all of the original clock pulse signals on some of the first set of second clock pulse signals wherein the number of the superposed first set of second clock pulse signals is equal to a difference obtained as a result of subtraction of the vertical-pixel count of the first video signal from the predetermined vertical-pixel count of the display unit, the first set of second clock pulse signals being in a desired horizontal period, the first gate-clock signals containing the original clock pulse signals and the superposed first set of second clock pulse signals and being for the two kinds of adjacent fields; and a first gate driving circuit to receive the first gate clock signals from the first gate-clock generating circuit and to generate first gate driving signals used for driving a predetermined number of gate lines as pulses of the first gate clock signals for each horizontal period, wherein the first gate clock signals generated from the first gate-clock generating circuit cause the first gate driving circuit to generate the different first gate driving signals for two adjacent gate lines in the same field, a second pulse generating circuit to display the screen on the display unit by using the two kinds of adjacent fields by writing a video signal in a horizontal period into two adjacent gate lines of the display unit wherein, in an operation to display a second video signal having a second vertical-pixel count greater than the predetermined vertical-pixel count of the display unit, the second video signal is thinned by generating a second set of second clock pulse signals for a thinning purpose with a desired timing in a desired horizontal period in addition to two original clock pulse signals generated in a horizontal period as required in an operation of displaying the video signal having the vertical-pixel count equal to the predetermined vertical-pixel count of the display unit, the second set of second clock pulse signals having pulses corresponding to positions of the original clock pulse signals to be thinned, and by repeating generation of the original clock pulse signals for each horizontal period and generation of the second set of second clock pulse signals for a desired horizontal period;

a second gate-clock generating circuit to receive the original clock pulse signals and the second set of second clock pulse signals from the second pulse generating circuit and to generate second gate-clock signals obtained as a result of superposing all of the original clock pulse signals on some of the second set of second clock pulse signals wherein the number of the superposed second set of second clock pulse signals is equal to a difference obtained as a result of subtraction of the second vertical-pixel count of the display unit from the predetermined vertical-pixel count of the video signal, the second set of second clock pulse signals being in a desired horizontal period, the second gate-clock signals containing the original clock pulse signal thinned by the desired superposed second set of second clock pulse signals and being for the two kinds of adjacent fields; and a second gate driving circuit to receive the second gate clock signals from the second gate-clock generating circuit and to generate second gate driving signals used for driving a predetermined number of gate lines as pulses of the second gate clock signals for each horizontal period, wherein the second gate clock signals generated from the second gate-clock generating circuit cause the second gate driving circuit to generate the different second gate driving signals for two adjacent gate lines in the same field, and further comprising a discriminating circuit to determine which of the first pulse generating circuit and the second pulse generating circuit is to be used.

* * * * *